US011771179B2

(12) United States Patent
Kim

(10) Patent No.: US 11,771,179 B2
(45) Date of Patent: Oct. 3, 2023

(54) STRING ADJUSTMENT DEVICE

(71) Applicant: Sug Whan Kim, Gimpo-si (KR)

(72) Inventor: Sug Whan Kim, Gimpo-si (KR)

( * ) Notice: Subject to any disclaimer, the term of this patent is extended or adjusted under 35 U.S.C. 154(b) by 393 days.

(21) Appl. No.: 17/273,786

(22) PCT Filed: Sep. 2, 2019

(86) PCT No.: PCT/KR2019/011239

§ 371 (c)(1),
(2) Date: Sep. 3, 2021

(87) PCT Pub. No.: WO2020/050562

PCT Pub. Date: Mar. 12, 2020

(65) Prior Publication Data

US 2021/0401121 A1 Dec. 30, 2021

(30) Foreign Application Priority Data

Sep. 7, 2018 (KR) ..... 10-2018-0107030
Aug. 30, 2019 (KR) ..... 10-2019-0107510

(51) Int. Cl.

| | |
|---|---|
| ***A43C 11/16*** | (2006.01) |
| ***A41F 1/00*** | (2006.01) |
| ***A43C 11/14*** | (2006.01) |
| ***A45C 13/30*** | (2006.01) |

(52) U.S. Cl.

CPC ..... *A43C 11/165* (2013.01); *A41F 1/00* (2013.01); *A43C 11/146* (2013.01); *A45C 13/30* (2013.01)

(58) Field of Classification Search

CPC ..... A43C 11/165; A43C 11/146; A43C 11/14; A41F 1/00; A41F 1/008; A41F 1/06; A45C 13/30

See application file for complete search history.

(56) References Cited

U.S. PATENT DOCUMENTS

| | | | | |
|---|---|---|---|---|
| 8,832,912 | B2 * | 9/2014 | Ha | A43C 11/165 24/712.9 |
| 9,486,039 | B2 * | 11/2016 | Ha | A42B 1/22 |
| 10,076,160 | B2 * | 9/2018 | Burns | A44B 11/065 |
| 10,264,852 | B2 * | 4/2019 | Kim | A43C 11/165 |
| 10,368,613 | B2 * | 8/2019 | Ha | A43C 7/00 |
| 11,019,882 | B2 * | 6/2021 | Chen | A43C 11/165 |
| 2011/0266384 | A1 | 11/2011 | Goodman et al. | |

(Continued)

FOREIGN PATENT DOCUMENTS

| | | |
|---|---|---|
| JP | 2013-022467 | 2/2013 |
| KR | 10-1723578 | 4/2017 |

(Continued)

*Primary Examiner* — David M Upchurch

(74) *Attorney, Agent, or Firm* — LEX IP MEISTER, PLLC

(57) ABSTRACT

The present invention discloses a string adjuster that can adjust the length of a string by winding the string.

A string adjuster of the present invention includes a fixed unit and a rotation unit, in which a knob of the rotation unit includes a first extension having a counter-anti-separator formed on the interior circumferential surface and preventing separation from a housing, a second extension having a winding determination protrusion formed on the interior circumferential surface and determining winding and releasing modes, and a spacing groove formed between the first extension and the second extension.

20 Claims, 25 Drawing Sheets

(56) References Cited

U.S. PATENT DOCUMENTS

| | | | | |
|---|---|---|---|---|
| 2015/0191326 | A1* | 7/2015 | Hall | B65H 75/4431<br>242/396.4 |
| 2017/0027287 | A1* | 2/2017 | Burns | A61F 5/0118 |
| 2018/0132567 | A1* | 5/2018 | Lee | A43C 11/20 |
| 2018/0160775 | A1* | 6/2018 | Pollack | A43C 7/00 |
| 2018/0319617 | A1* | 11/2018 | Kim | A44B 11/125 |

FOREIGN PATENT DOCUMENTS

| | | |
|---|---|---|
| KR | 10-2017-0122462 | 11/2017 |
| KR | 10-2018-0097059 | 8/2018 |

* cited by examiner

STRING ADJUSTMENT DEVICE

TECHNICAL FIELD

The present invention relates to a string adjuster that is combined with products including a shoe, a bag, clothing, a glove, a headgear, etc. and can adjust the length by winding a string, a rope, a wire, a band, a tape, a strap, etc.

BACKGROUND ART

In general, products including a shoe, a bag, clothing, a glove, a headgear, etc. have a string, or a rope, a wire, a band, or a strap similar to a sting. A user can pull both ends of a string and tie the string or loose the string by untying it when using products having such a string. For examples, shoes with a string have strings for bringing the shoes in close contact with user's feet. Such strings can be tied after the strings are fit zigzag in shoes and then both ends are pulled and tightened.

A wearer has to loosen a string and then tighten and tie again when putting on shoes with a string in the related art. The wearer has to loose again the string tied on the shoe when taking off the shoe. As described above, shoes with a string in the related art have a drawback that it is very complicated to use them.

A tightener that winds a string is used to remove such complication. String tighteners of the related art have a drawback that the structure is complicated and there are many parts, so the size thereof is large. Accordingly, such string tighteners of the related art have a drawback that they are large in size, so they are difficult to apply to products that influence an esthetic sense such as underwear, fashion shoes, headgears, bags, and wallets, or wearable products or apparel products of which the size is important.

DISCLOSURE

Technical Problem

The present invention has been made in an effort to provide a string adjuster having advantages of convenient use by enabling a user to easily tighten or loose a string applied to wearable products including shoes, a bag, clothing, a headgear, a glove, etc.

Further, the present invention provides a string adjuster having advantages of improved convenience of assembly and production because the number of parts having charge of an operation function in the internal structure is minimized.

Further, the present invention provides a string adjuster having advantages that the string adjuster can be manually maintained by a user because the assembly process is minimized and parts can be easily replaced due to easy assembly and disassembly.

Further, the present invention provides a string adjuster having advantages of improving convenience of use and an esthetic sense because the size, the diameter, or the volume is small to be easily applied to various products such as wearable products including shoes, a bag, clothing, a headgear, a glove, etc.

Further, the present invention provides a string adjuster having advantages of having a wide application range by enabling one or, two or more strings to be simultaneously wound and tightened.

Technical Solution

In order to achieve the objects of the present invention, the present invention provides a string adjuster that includes:

a fixed unit including a base, and a housing connected to the base and having a space therein;

a rotation unit including a knob connected to the housing and rotating or moving a predetermined section in a direction parallel with an axis, and a bobbin disposed in the fixed unit and rotating with rotation of the knob to wind a string, in which the housing includes a reference locking portion, and an anti-separator spaced apart from the reference locking portion and preventing separation of the knob, and the knob includes a first extension having a counter-anti-separator corresponding to the anti-separator and preventing separation from the housing, a second extension having a winding determination protrusion determining winding and releasing modes, and a spacing groove formed between the first extension and the second extension.

Further, the present invention provides a string adjuster that includes: a fixed unit including a base, and a housing connected to the base and having a space therein; and a rotation unit including a knob connected to the housing and rotating or moving a predetermined section in a direction parallel with an axis, and a bobbin disposed in the fixed unit and rotating with rotation of the knob to wind a string, in which the housing includes a reference locking portion, and an anti-separator spaced apart from the reference locking portion and preventing separation of the knob, and the knob has a first extension and a second extension, and a sparing groove formed at both sides of the second extension, in which a surface corresponding to the anti-separator forms a counter-anti-separator at the second extension, and a winding determination protrusion is formed on another surface of the counter-anti-separator.

Further, the present invention provides a string adjuster that includes: a fixed unit including a base, and a housing connected to the base and having a space therein; and a rotation unit including a knob coupled to the housing and rotating or moving a predetermined section in a direction parallel with an axis, and bobbin disposed in the housing, coupled to the knob by a fastening member or integrally formed with the knob, and rotating with the knob to wind a string thereon, in which the housing includes a reference locking portion, and an anti-separator spaced apart from the reference locking portion and preventing separation of the knob, and the knob includes a first extension having a counter-anti-separator corresponding to the anti-separator and preventing separation from the housing, a second extension having a winding determination protrusion determining winding and releasing modes, and a spacing groove formed between the first extension and the second extension.

It is preferable that the second extension is an elastic part that radially moves and then returns when the winding determination protrusion slide over the reference locking portion.

It is preferable that the first extension and the second extension are alternately disposed along the external circumferential surface of the knob.

It is preferable that, in the first extension and the second extension, when the knob is seen from above, the distance from the center of the rotation axis of the knob to the external circumferential surface of the first extension.

It is preferable that the knob includes an anti-reverse part having gear teeth protruding toward the base therein, and a driving gear part having gear teeth protruding toward the base therein, and formed at the center with respect to the anti-reverse part, the housing includes a first housing and a second housing disposed in the first housing, the second housing has an anti-reverser arm coupled to the anti-reverse part and preventing backward rotation of the knob, and the bobbin has a driven gear part coupled to the driving gear part and rotating the bobbin.

It is preferable that the anti-reverse part and the anti-reverse arm have gear teeth formed in the direction parallel with the axis, and the driving gear part and the driven gear part have gear teeth formed in the direction parallel with the axis.

It is preferable that the anti-reverse arm is integrally formed with the second housing, extends, has a free end, and has gear teeth protruding toward the knob, and a space is formed under the anti-reverse part such that the free end moves in the direction parallel with the axis when the protruding gear teeth of the anti-reverse part slide over the protruding gear teeth of the anti-reverse arm.

It is preferable that the protruding gear teeth of the anti-reverse part are inclined in the opposite direction to the protruding gear teeth of the driving gear teeth, and have an inclination angle that is different from the inclination angle of the gear teeth of the driving gear part.

It is preferable that the gear teeth of the anti-reverse part have a size that is larger than the size of the gear teeth of the driving gear part.

It is preferable that the gear teeth of the driving gear part have an inclination angle that is larger than the inclination angle of the gear teeth of the anti-reverse part.

It is preferable that the anti-reverse part has two or more inclined gear teeth.

It is preferable that the anti-reverse part is disposed in contact with or adjacent to the inner wall of the first housing so that radial movement of the external circumferential surface thereof is restricted by the inner wall of the first housing.

It is preferable that the housing includes a first housing coupled to or integrally formed with the base, and a second housing disposed in the first housing.

It is preferable that the first housing has a first fitting protrusion radially protruding from the bottom, and the base has a first fitting groove correspondingly fitted on the first fitting protrusion.

It is preferable that the second housing has at least one or more second fitting protrusions radially protruding from the bottom, and the first housing has second fitting grooves correspondingly fitted on the second fitting protrusions.

It is preferable that the second fitting protrusions have an arranging protrusion that is one of the second fitting protrusions which is larger in size than the other, and the second fitting grooves have an arranging groove that is one of the second fitting grooves which is a size corresponding to the arranging protrusion.

It is preferable that the first housing has a reinforcing rib radially protruding circumferentially along the external circumferential surface.

It is preferable that the first housing has a coupling protrusion protruding toward the center from the interior circumferential surface, and the second housing has a coupling groove correspondingly fitted on the coupling protrusion.

It is preferable that the first housing has one or more string inserting portions having hole shapes formed through the bottom, and the second housing has other string inserting portions corresponding to the string inserting portions.

It is preferable that the bobbin has a column part, and the column part has an oblong groove formed through the center portion in a direction perpendicular to the axis, and has one or more string fitting grooves formed in parallel with or through the oblong groove.

It is preferable that the string fitting grooves are formed at a predetermined angle with respect to each other such as strings perpendicularly passing through the oblong groove or fitted in the oblong groove are disposed across each other.

It is preferable that the bobbin includes a column part through which a string passes or to which a string is tied and on which a string is wound, a first plate integrally formed with the column part on the top of the column part, and a second plate integrally formed with the column part on the bottom of the column part, and the first plate and the second plate have a guide groove hollowed out toward the center of the axis and guiding strings.

It is preferable that the bobbin has a rotation shaft protrusion on a surface facing the base, and the base has a rotation shaft groove corresponding to the rotation shaft protrusion.

It is preferable that the bobbin has a rotation guide protrusion on a surface facing the base, and the base has a rotation guide groove guiding rotation of the bobbin with the rotation guide protrusion fitted therein.

It is preferable that the knob includes a gear plate coupled to the inner surface thereof by fitting, bonding, or thermal bonding, and the gear plate includes an anti-reverse part having gear teeth protruding toward the base, and a driving gear part having gear teeth formed toward the base, and formed at the rotation center axis with respect to the anti-reverse part.

It is preferable that the first housing and the second housing are integrally formed and coupled to the base.

Advantageous Effects

There is an advantage that when the string adjuster is applied to a wearable product such as a shoe, a bag, and clothing, a user can easily tightens a string only by pressing and rotating the rotation unit, whereby the string adjuster is convenient to use.

Further, the present invention has an effect that since assembly and disassembly are easy and the number of parts is minimized, convenience for assembly and production is improved in comparison to the existing products.

Further, the present invention has an effect that since a user can easily disassemble the rotation unit and the fixed unit, assembly and disassembly are easy, so the assembly process is minimized and parts are easily replace, whereby convenience of maintenance is improved.

Further, the present invention enables a user to maximize tension of a string through a simple operation and can be easily applied to shoes or wearable products that require tension of strings.

Further, according to the present invention, since several strings can be simultaneously used, the application products can be increased.

Further, according to the present invention, since the base is manufactured in a separable type, when the string adjuster of the present invention is applied to a product such as a shoe, it is possible to couple the base first to the product and then couple the housing to the base. According to the present invention, the process of assembling a product and the process of assembling the string adjuster are separate, so convenience of assembly and production can be improved.

MODE FOR INVENTION

Figure 1:
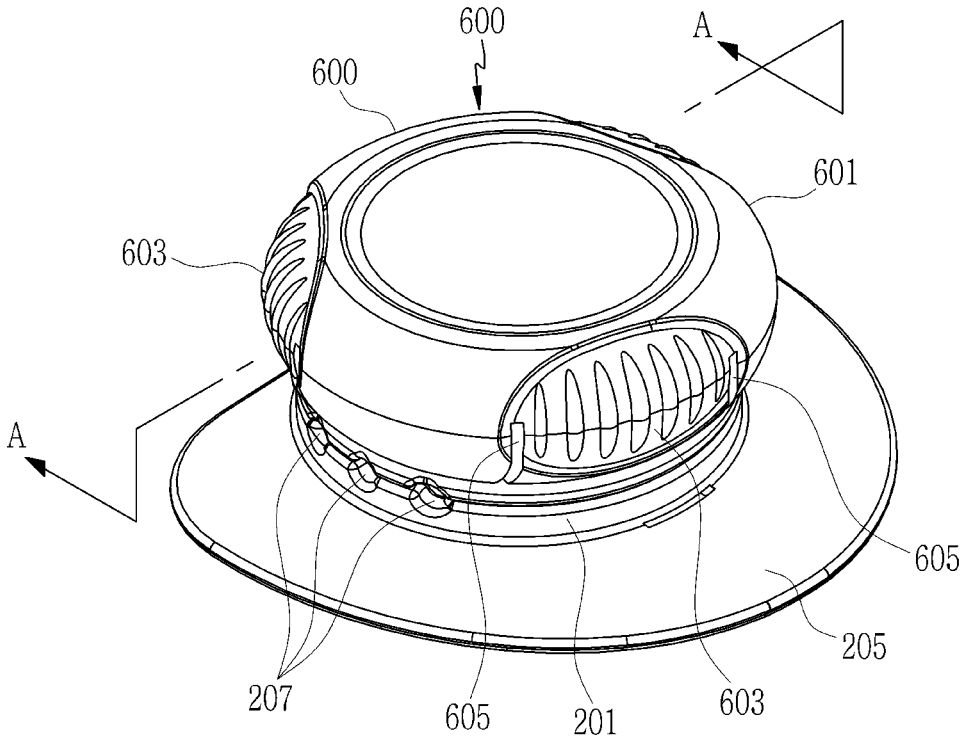
FIG. 1 is a view showing the entire shape of a string adjuster to describe a first exemplary embodiment of the present invention.

Hereafter, the present invention will be described more fully with reference to the accompanying drawings, in which exemplary embodiments of the invention are shown. However, the present invention may be modified in various different ways and is not limited to the embodiments described herein. In the accompanying drawings, portions unrelated to the description will be omitted in order to obviously describe the present invention, and similar reference numerals will be used to describe similar portions throughout the present specification.

In exemplary embodiments of the present invention, a string is defined as an object having a length such as a rope, a wire, a band, a tape, a strap, a lade, or a chain (for a necklace).

Figure 2:
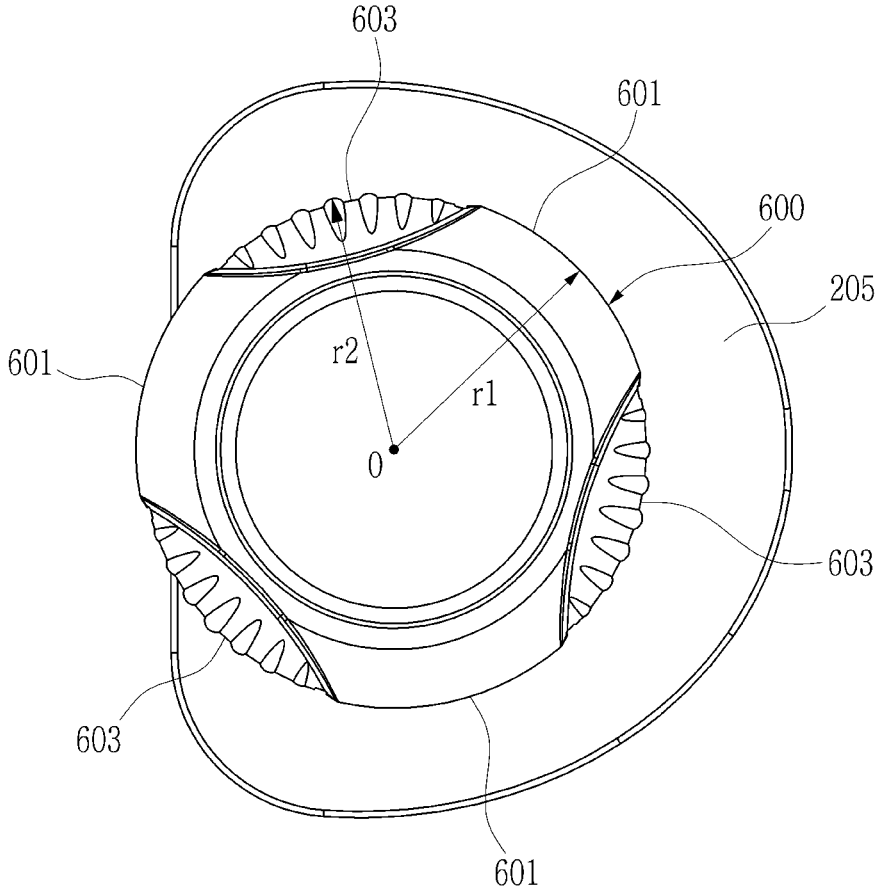
FIG. 2 is a top plan view showing the string adjuster to describe the first exemplary embodiment of the present invention.

FIG. 1 is a perspective view illustrating a first exemplary embodiment of the present invention and FIG. 2 is a top plan view showing a string adjuster.

A string adjuster according to a first exemplary embodiment of the present invention includes a fixed unit 100 and a rotation unit 500 rotatably coupled to the fixed unit 100.

Figure 3:
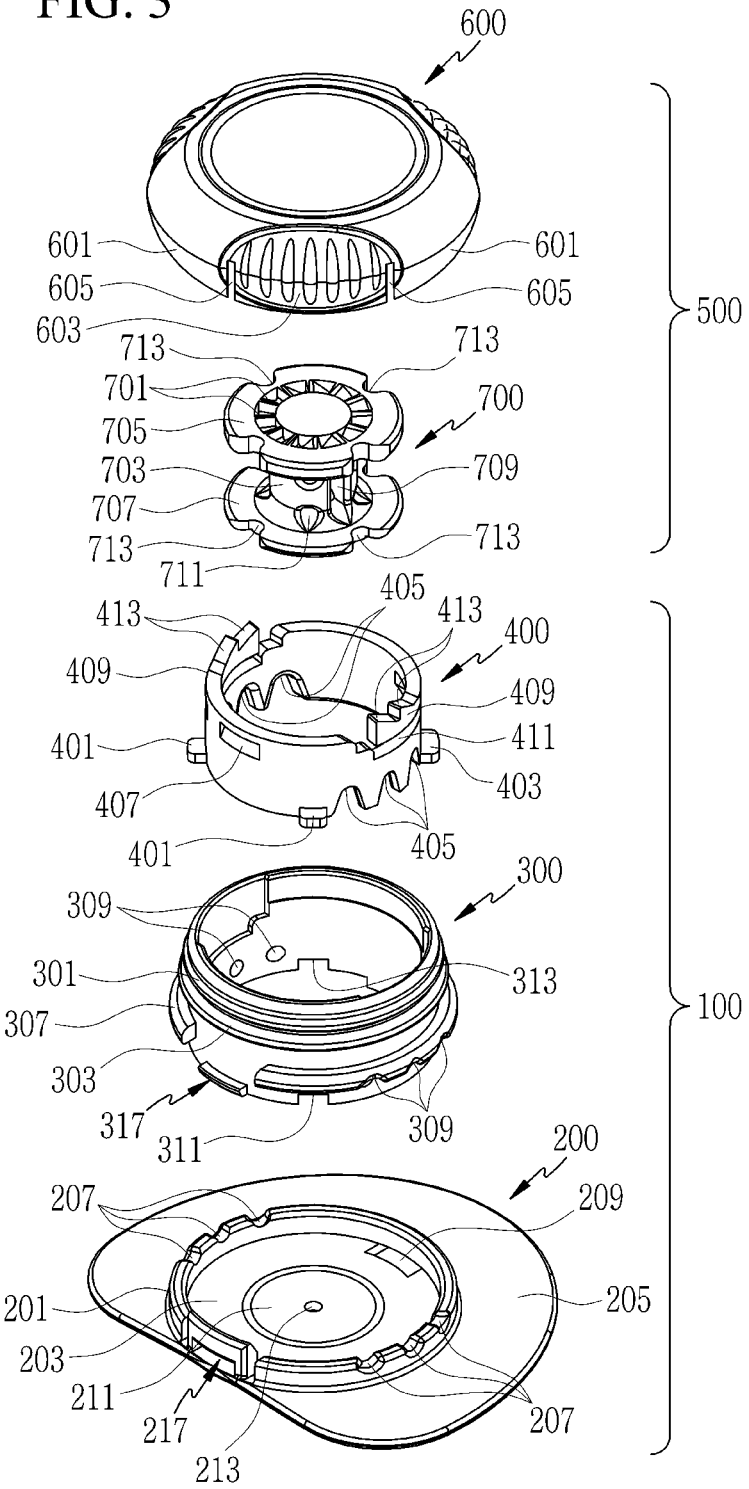
FIG. 3 is an exploded perspective view showing the string adjuster of the first exemplary embodiment of the present invention.
Figure 4:
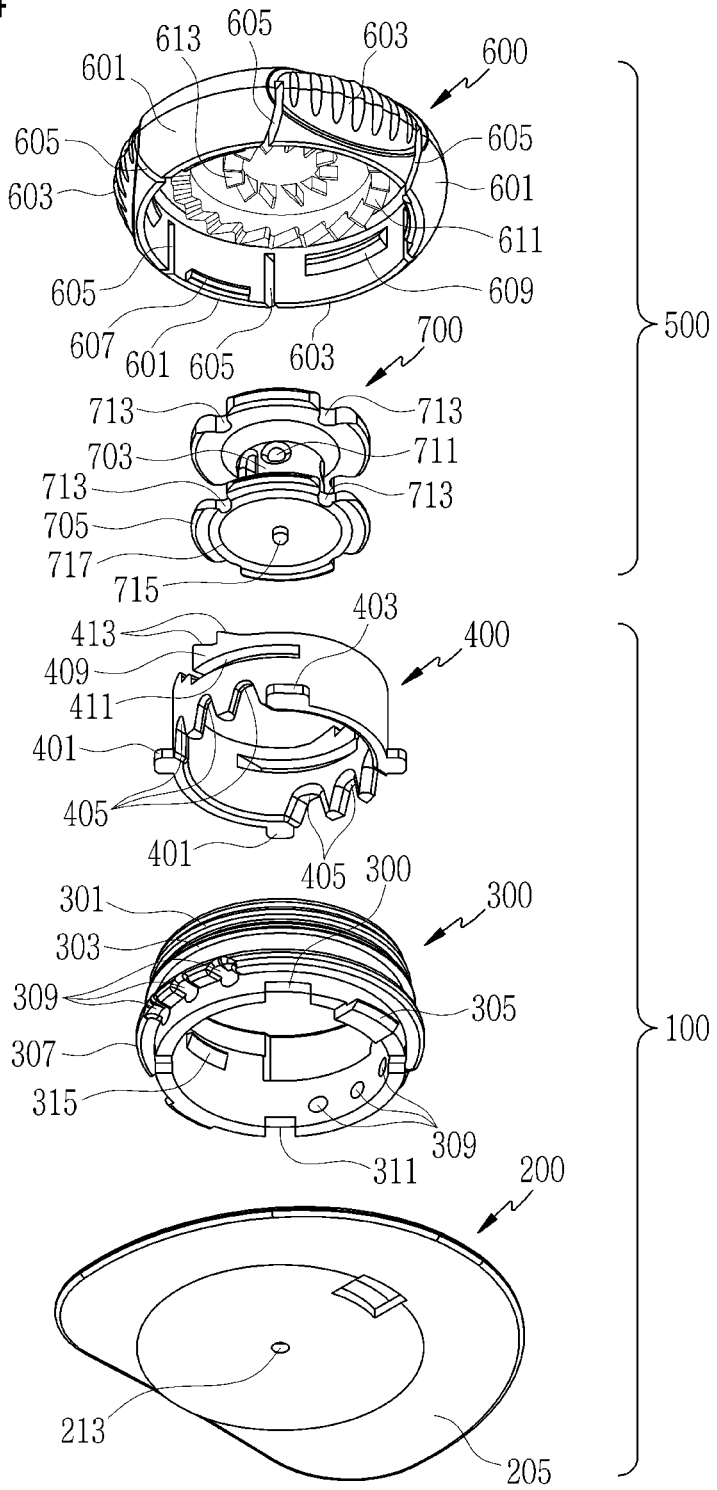
FIG. 4 is an exploded perspective view showing the string adjuster of the first exemplary embodiment of the present invention seen from the bottom.
Figure 6:
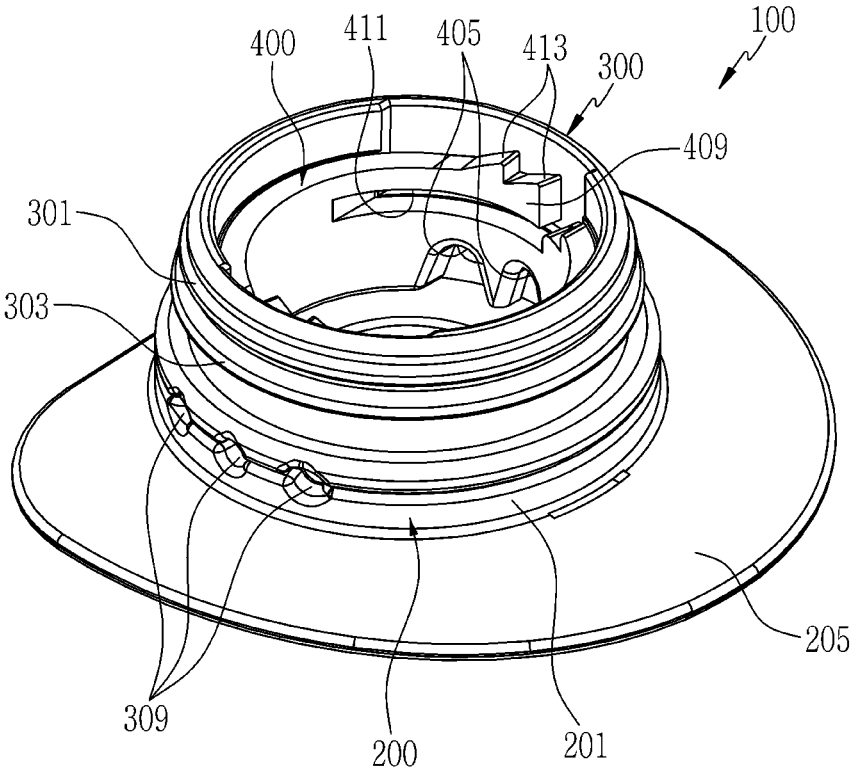
FIG. 6 is a perspective view showing a fixing unit of the first exemplary embodiment of the present invention.

The fixed unit 100 includes a base 200, a first housing 300, and a second housing 400 (see FIGS. 3 and 4). The base 200, the first housing 300, and the second housing 400 constituting the fixed unit 100 may be manufactured as independent parts and then combined with each other, or may be integrally formed (see FIG. 6). The first housing 300 and the second housing 400 constituting the fixed unit 100 may be integrally formed and coupled to the base 200.

As described above, when the base 200, the first housing 300, and the second housing 400 are integrally formed or the first housing 300 and the second housing 400 are integrally formed, the number of parts of the string adjuster additionally decreases, so convenience of assembly, production, and maintenance may be further improved.

The fixed unit 100 of the first exemplary embodiment of the present invention is described by exemplifying the case in which the base 200, the first housing 300, and the second housing 400 are manufactured as separate parts and then combined with each other.

Figure 7:
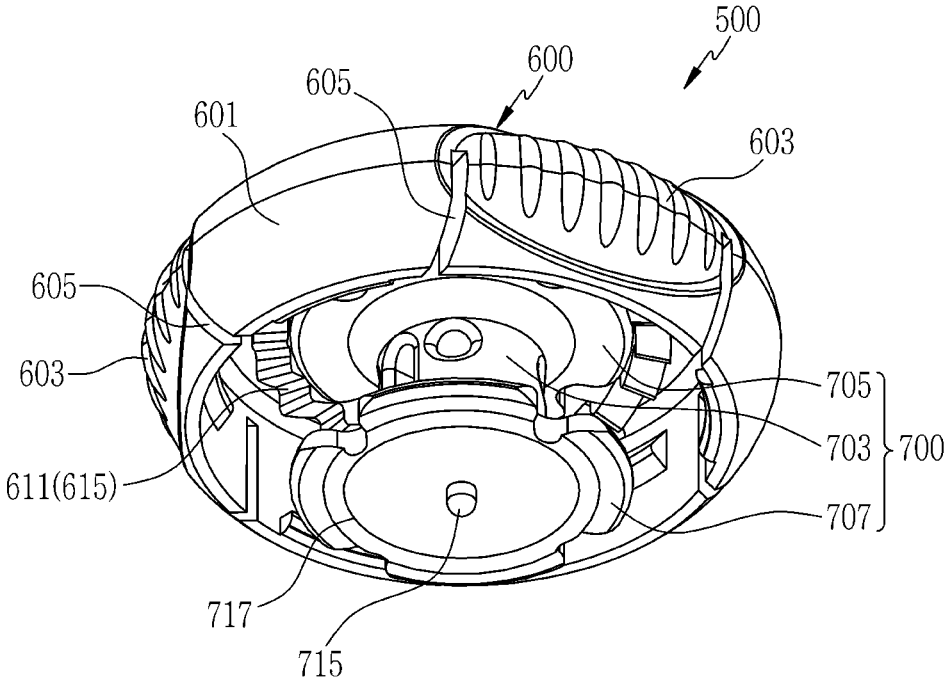
FIG. 7 is a perspective view showing a rotation unit of the first exemplary embodiment of the present invention.
Figure 8:
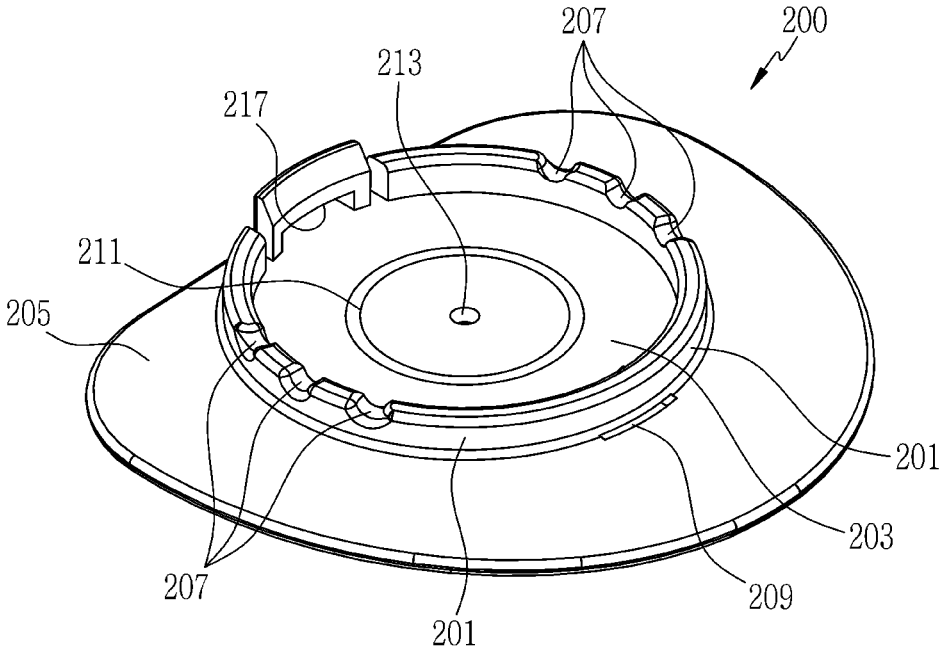
FIG. 8 is a perspective view showing a base of the first exemplary embodiment of the present invention.

The rotation unit 500 is coupled to the fixed unit 100 and can adjust tension of a string while rotating. The rotation unit 500 can perform a winding mode in which it winds a string by moving in parallel with the axis and a releasing mode in which it can reduce the tension of the string or can loose the string. The rotation unit 500 includes a knob 600 and a bobbin 700 (see FIGS. 3 and 4). The knob 600 and the bobbin 700 constituting the rotation unit 600 may be manufactured as separate parts and the combined with each other or may be integrally formed (see FIG. 7). When the knob 600 and the bobbin 700 are integrally formed, the number of parts of the string adjuster further decreases, so convenience of assembly, production, and maintenance may be further improved.

The rotation unit 500 of the first exemplary embodiment of the present invention is described by exemplifying the case in which the knob 600 and the bobbin 700 are manufactured as separate parts and then combined with each other.

The base 200, as shown in FIGS. 2 to 6 and FIG. 8, includes a base housing part 201, a base bottom 203, and a coupling extension 205.

The base housing part 201 may be formed in a cylindrical shape having a space at the center portion. The base housing part 201 includes one or more first string inserting portions 207 on the top. The first string inserting portion 207 may be formed by cutting the front end of the base housing part 201 toward the base bottom 203. A plurality of first string inserting portions 207 may be disposed adjacent to each other. The first string inserting portions 207 may be formed in the same shape and number at positions facing each other (see FIG. 8). One or more string may be fitted in the first string inserting portions 207. A first fitting groove 209 is formed at a side inside the base bottom 203. The first fitting groove 209 serves to couple and fix the first housing 300 to the base 200.

The base housing part 201 has another fitting groove 217 for fitting the first housing 300. The fitting groove 217 of the base housing part 201 may be a hole formed radially around the axis. The first housing 300 has a fitting protrusion 317 on the outer surface which is fitted in the fitting groove 217 of the base housing part 201. Accordingly, the first housing 300 can be coupled to the base 200 by fitting the first fitting protrusion 305 and the fitting protrusion 317 into the first fitting groove 209 and the fitting groove 217, respectively.

The base bottom 203 is a bottom closing the bottom of the base housing part 201. The base bottom 203 has a rotation guide groove 211 and a rotation shaft groove 213.

The rotation guide groove 211 has a shape cylindrically hollowed out. The bobbin 700 is fitted to be freely rotatably in the rotation guide groove 211. The rotation guide groove 211 enables the bobbin 700 to smoothly rotate while maintaining the posture without separating from the base bottom 230 when the bobbin 700 moves in a direction parallel with the axis while rotating.

The rotation shaft groove 213 may be an opening or a groove formed at the center of the axis. The axial center of the bobbin 700 is fitted in the rotation shaft groove 213, whereby the rotation center of the bobbin 700 is maintained when the bobbin 700 is rotated.

The coupling extension 205 radially extends from a portion of or the entire external circumferential surface of the base housing part 201. The coupling extension 205 may be made of a synthetic resin material having excellent flexibility or having elasticity. The coupling extension 205 may be made of the same material as the base housing part 201 and may be integrally formed with the base housing part 201. The coupling extension 205 may be formed in a thin plate shape, whereby the flexibility can be increased. The coupling extension 205 may be fixed to a wearable product such as a shoe, a bag, or clothing by sewing, bonding, or the like.

Figure 9:
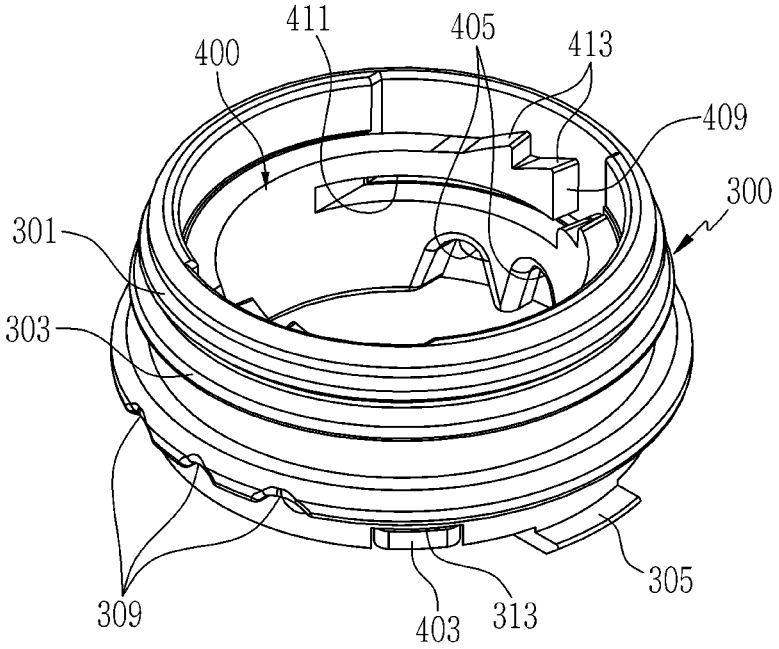
FIG. 9 is a perspective view showing a housing of the first exemplary embodiment of the present invention.
Figure 10:
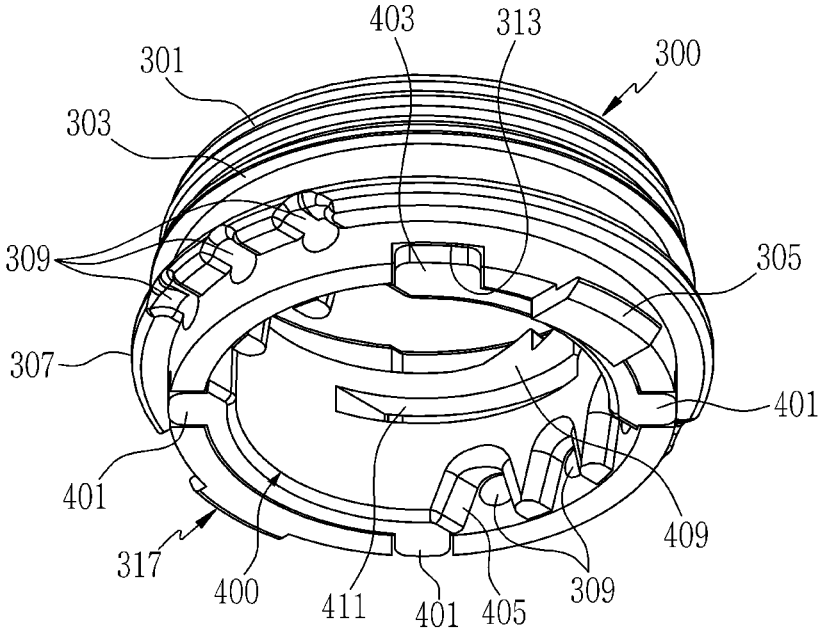
FIG. 10 is a perspective view showing the housing of the first exemplary embodiment of the present invention seen from the bottom.
Figure 11:
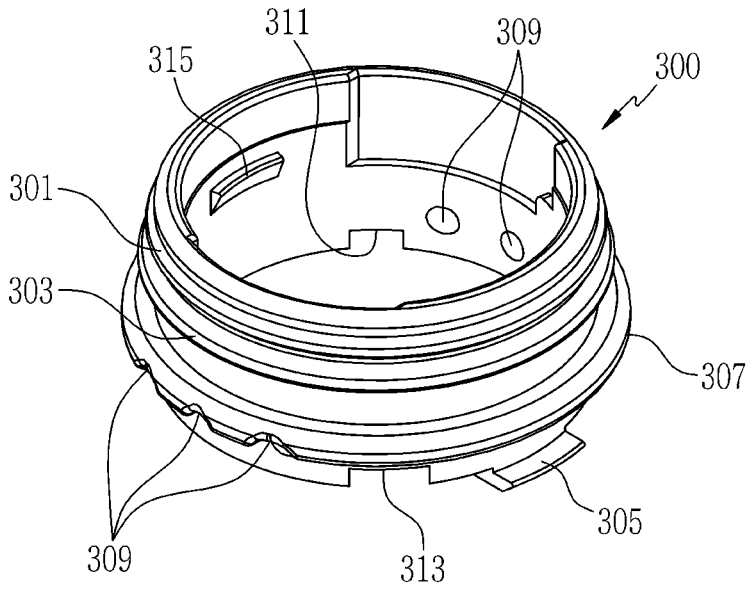
FIG. 11 is a perspective view showing a first housing of the housing of the first exemplary embodiment of the present invention.
Figure 12:
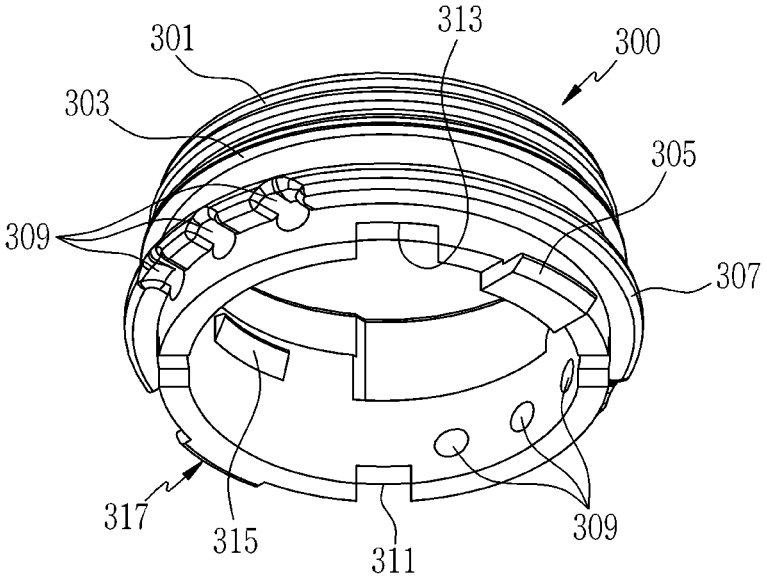
FIG. 12 is a perspective view showing the first housing of the housing of the first exemplary embodiment of the present invention seen from the bottom.

FIG. 9 is a view illustrating the first exemplary embodiment of the present invention and shows an example in which the first housing 300 and the second housing 400 have been combined with each other. FIG. 10 is a perspective view of FIG. 9 seen from the bottom. FIG. 11 is a perspective view showing the first housing 300 to describe the first exemplary embodiment of the present invention seen from the bottom and FIG. 12 is a perspective view of FIG. 11 seen from the bottom.

The first housing 300 may be formed in a cylindrical shape having an internal space. The first housing 300 includes a reference locking portion 301 radially protruding from the external circumferential surface. The first housing 300 includes an anti-separator 303 radially protruding from the external circumferential surface and spaced apart from the reference locking portion 301 in the direction parallel with the axis. In the first exemplary embodiment of the present invention, the reference locking portion 301 is coupled to the middle portion of the first housing 300 and the anti-separator 303 is disposed closer to the base 200 further than the reference locking portion 301.

The reference locking portion 301 implements a winding mode in which a string is wound on the bobbin 700 and a releasing mode in which the string is loosened, when the knob 600 is moved in the direction parallel with the axis.

The anti-separator 303 prevents the knob 600 from completely separating from the first housing 300 when the knob 600 is moved in the axial direction. It is preferable that, in the anti-separator 303, the surface facing the base 200 is flat or curved to lock a counter-anti-separator 607 of the knob 600.

The first housing 300 has a first fitting protrusion 305 radially protruding on the bottom thereof. The first fitting protrusion 305 of the first housing 300 can be fitted in the first fitting groove 209 of the base 200. That is, the first housing 300 can be fixed to the base 200 by fitting the first fitting protrusion in the first fitting groove 209. Obviously, when the base 200 and the first housing 300 are integrally formed, the first fitting protrusion 305 of the first housing 300 and the first fitting groove 209 of the base 200 may be omitted.

The first housing 300 may have a reinforcing rib 307 radially protruding on the external circumferential surface. The reinforcing rib 307 of the first housing 300 can decrease the thickness of the first housing 300 and increase the strength of the first housing 300. Accordingly, it is possible to manufacture the string adjuster employing the first housing 300 having the reinforcing rib 307 in a compact size with satisfactory durability by reducing the entire size (volume or diameter).

The first housing 300 has a plurality of string inserting portions 309 that are openings formed through the side wall thereof toward the center of the axis. The first housing 300 may have one or more string inserting portions 309. The first housing 300 may have 2 or, three or more string inserting portions 309 disposed with regular intervals. In the first housing 300, the same size and number of other string inserting portions 309 may be formed opposite to the string inserting portions 309 of the first housing 300 (shown in FIGS. 11 and 12). Due to the string inserting portions 309 of the first housing 300, it is possible to simultaneously tie and fix several strings on the bobbin 700 or hook the strings through the bobbin 700.

The first housing 300 has a plurality of second fitting grooves 311 and arranging grooves 313 formed on the bottom toward the center of the axis. The second fitting grooves 311 of the first housing 300 are provided to coupling the second housing 400. When the second housing 400 is coupled to the first housing 300, the first housing 300 and the second housing 400 are arranged at predetermined positions by the arranging grooves 313 of the first housing 300. The arranging grooves 313 may be different in size from the second fitting groove 311 in the first housing 300. That is, the arranging grooves 313 of the first housing 300 guides the second housing 400 to be aligned with and easily fitted in the first housing 300. That is, the arranging groove 313 may be provided by making the size of one of the second fitting grooves 311 of the first housing different from those of the others. As another example of the first exemplary embodiment of the present invention, the first housing 300 and the second housing 400 may be integrally formed, and in this case, the second fitting grooves 311 and arranging grooves 313 of the first housing 300 may be omitted.

The first housing 300 has a coupling protrusion 315 protruding toward the center from the interior circumferential surface to couple the second housing 400.

It is preferable that the coupling protrusion 315 of the first housing 300 has an inclined surface formed in the fitting direction in the coupling groove 407 of the second housing 400. The coupling protrusion 315 of the first housing 300 easily couples the coupling protrusion 407 of the second housing 400, thereby improving the convenience of assembly.

Figure 13:
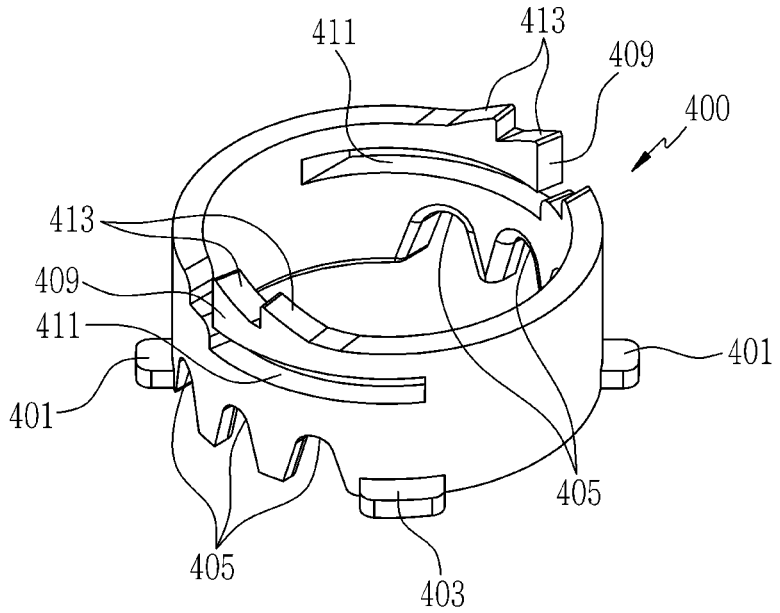
FIG. 13 is a perspective view showing a second housing of the housing of the first exemplary embodiment of the present invention.
Figure 14:
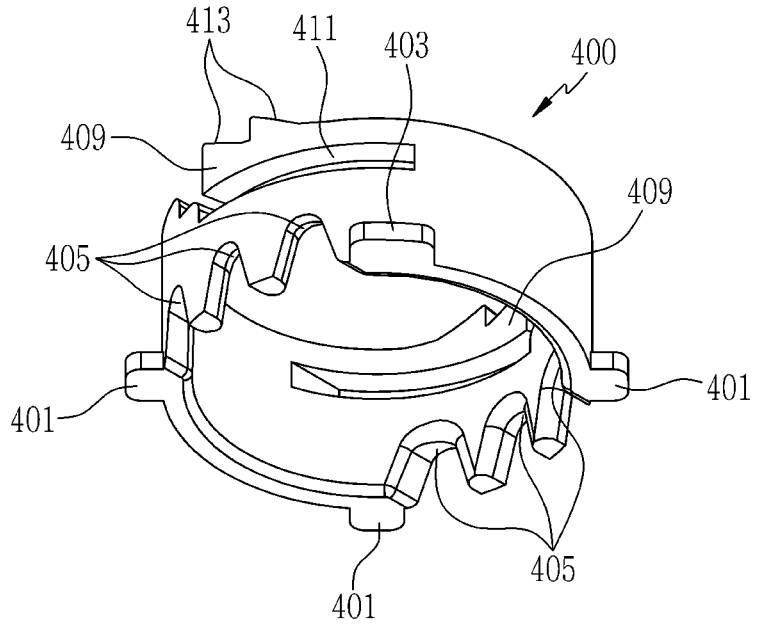
FIG. 14 is a perspective view showing the second housing of the housing of the first exemplary embodiment of the present invention seen from the bottom.

The second housing 400 is inserted in the internal space of the first housing 300, whereby the second housing 300 can be integrally coupled and fixed to the first housing 300. The second housing 400 may be formed in a cylindrical shape having an internal space (see FIGS. 13 and 14). The second housing has one or more second fitting protrusions 401 and arranging protrusions 403 radially protruding from an end toward the base 200.

The second fitting protrusions 401 of the second housing 400 are correspondingly fitted in the second fitting grooves 311 of the first housing 300. That is, the second fitting protrusions 401 of the second housing 400 and the second fitting grooves 311 of the first housing 300 are the same in size and number. The arranging protrusions 403 of the second housing 403 are correspondingly fitted in the arranging grooves 313 of the first housing 300. That is, the arranging protrusions 403 of the second housing 400 are also different in size from the second fitting grooves 401 and have a size that is fitted in the arranging groove 313 of the first housing 300. Accordingly, when coupling the second housing 400 to the first housing 300, an assembler who assembles them can arrange and assemble the first housing 300 and the second housing 400 by fitting the arranging protrusions 403 of the second housing 400 into the arranging grooves 314 of the first housing 300. According to the first exemplary embodiment of the present invention, since an assembler can easily align and assembly the first housing 300 and the second housing 400, the convenience of assembly and production can be improved and poor quality due to poor assembly can be prevented.

The second housing 400 has other string inserting portions 405 corresponding to the string inserting portions 309 of the first housing 300. The string inserting portions 405 of the second housing 400 may be holes or grooves formed toward the center of the axis. It is preferable that the number and position of the string inserting portions 405 of the second housing 400 are the same as those of the string inserting portions 309 of the first housing 300. The string inserting portions 405 of the second housing 400 are disposed at the same positions as the string inserting portions 309 of the first housing 300 when the first housing 300 and the second housing 400 are assembled.

The second housing 400 includes a coupling groove 407 corresponding to the coupling protrusion 315 of the first housing 300 (see FIG. 3). The coupling groove 407 of the second housing 400 may be an oblong groove formed toward the center of the axis. The coupling groove 407 of the second housing 400 may be correspondingly fitted on the coupling protrusion 315 of the first housing 300. The coupling grooves 407 of the second housing 400 are fitted on the coupling protrusions 315 of the first housing 300 when the first housing 300 and the second housing 400 are combined, whereby a firmly fixed state can be maintained. When the first housing 300 and the second housing 400 are integrally formed, the coupling protrusions 315 of the first housing 300 and coupling grooves 407 of the second housing 400 may be omitted.

The second housing 400 has an anti-reverse arm 409 that prevents backward rotation of the knob 600. The anti-reverse arm 409 of the second housing 400 is an arm having an end extending from the second housing 400 and another end that is a free end. A space 411 is defined under the anti-reverse arm 409 of the second housing 400 toward the base 200, so the free end of the anti-reverse arm 409 can move in the direction parallel with the axis. The anti-reverse arm 409 of the second housing 400 has elasticity to partially move in the direction parallel with the axis.

The anti-reverse arm 409 of the second housing 400 has gear teeth 413 protruding toward the knob 600 in the direction parallel with the axis. The anti-reverse arm 409 of the second housing 400 has at least one or more protruding gear teeth 413, and preferably, two or more gear teeth are continuously formed. When a force that rotates backward the knob 600 is applied, the structure in which the anti-reverse arm 409 of the second housing 400 has two or more inclined gear teeth 413 continuously formed sufficiently resists the force, thereby preventing backward rotation of the knob 600.

It is preferable that the anti-reverse arm 409 of the second housing 400 is elastically integrally formed with the second housing 400. It is preferable that the external circumferential surface of the anti-reverse arm 409 of the second housing 400 is in contact with or is disposed adjacent to the inner wall of the first housing 300 with a plurality of gaps therebetween.

Radial movement of the anti-reverse arm 409 of the second housing 400 is restricted with respect to the axis by the inner wall of the first housing 300. The anti-reverse arm 409 of the second housing 400 reduces damage when a larger force that rotates backward the knob 600 is applied, thereby increasing durability and quality.

Figure 15:
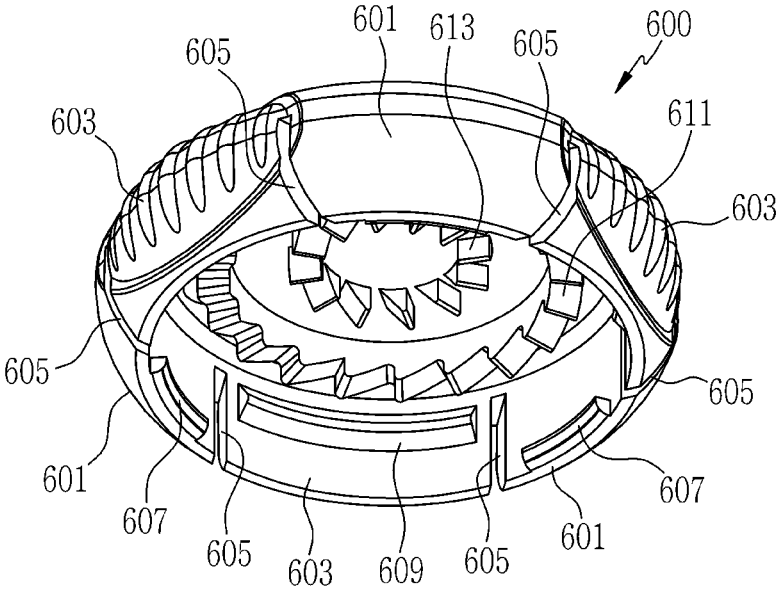
FIG. 15 is a perspective view showing a knob of the first exemplary embodiment of the present invention seen from the bottom.

Hereafter, the structure of the rotation unit 500 is described in detail with reference to FIGS. 15 and 16.

The knob 600 is coupled to the first housing 300, and rotates or moves a predetermined range in a direction parallel with the axis. That is, the knob 600 implements a winding mode in which a string is wound on the bobbin 700 by rotating when it is combined with the bobbin 700. The knob 600 implements a releasing mode in which a string can be loosened whet it is spaced apart from the bobbin 700. The knob 600 has a first extension 601, a second extension 603, and a spacing groove 605 (see FIG. 15).

The first extension 601 and the second extension 603 of the knob 600 may be circumferentially alternately formed by one or more with the spacing groove 605 therebetween. That is, the spacing groove 605 is formed at the boundary between the second extension 603 and the first extension 601 of the knob 600, so the second extension 603 can be radially moved a predetermined gap or returned. It is preferable that the second extension 603 of the knob 600 is an elastic part having elasticity. It is preferable that the elasticity of the second extension 603 of the knob 600 is larger than or at least the same as the elasticity of the first extension 601 of the knob 600.

The first extension 601 of the knob 600 has a counter-anti-separator 607 circumferentially formed in an arc shape and protruding toward the center of the axis from the interior circumferential surface thereof. The first extension 601 of the knob 600 prevents separation in the direction parallel with the axis from the first housing 300 in cooperation with the anti-separator 303 of the first housing 300. That is, the first extension 601 of the knob 600 is locked to the anti-separator 303 of the first housing 300 when the knob 600 is moved away from the base 200 in the direction parallel with the axis. Accordingly, the knob 600 is not easily separated from the first housing 300. That is, the first extension 601 of the knob 600 prevents the knob 600 from separating from the first housing 300 when the knob 600 enters the releasing mode by moving away from the base 200.

The second extension 603 of the knob 600 has elasticity to slight move and then return radially toward the external circumference from the center of the axis by the spacing grooves 605 formed in the direction parallel with the axis at both sides thereof.

The second extension 603 of the knob 600 has a winding determination protrusion 609 formed on the interior circumferential surface thereof. The winding determination protrusion 609 of the second extension 603 protrudes and elongates toward the center of the axis in an arc shape circumferentially on the interior circumferential surface of the second extension 603. It is preferable that the winding determination protrusion 609 of the second extension 603 is formed at a position where a predetermined gap is maintained from the counter-anti-separator 607 of the first extension 601 in the direction parallel with the axis.

The winding determination protrusion 609 of the second extension 603 can slide over the reference locking portion 301 of the first housing 300. In this case, the knob 600 can move in the direction parallel with the axis. That is, when the winding determination protrusion 609 of the second extension 603 is positioned closer to the base 200 than the reference locking portion 301 of the first housing 300, it is the winding mode in which a string can be wound on the bobbin 700. When the winding determination protrusion 609 of the second extension 603 is positioned farther away from the base 200 than the reference locking portion 301 of the first housing 300, it is the releasing mode in which a string can be unwound from the bobbin 700.

The spacing groove 605 of the knob 600 may be formed between the first extension 601 and the second extension 603. The spacing groove 605 of the knob 600 can implement the first exemplary embodiment of the present invention by having only to form spaces at both sides of the second extension 603.

The second extension 603 of the knob 600 has a free end extending from the knob 600 toward the base 200. The second extension 603 of the knob 600 is an elastic part that radially moves and then returns when the winding determination protrusion 609 slides over the reference locking portion 301 of the first housing 300.

It is preferable that the first extension 601, the second extension 603, and the spacing groove 605 of the knob 600 are alternately disposed along the side of the knob. That is, it is preferable that the first extension 601, the second extension 603, and the spacing groove 605 of the knob 600 are disposed toward the base on the side of the knob. The extension 601, the second extension 603, and the spacing groove 605 of the knob 600 are integrally formed.

An embossed surface or protrusions may be formed on the external circumferential surface of the second extension 603 of the knob 600. A user can hold and easily rotate or move in the direction parallel with the axis the first extension 601 of the second extension 603.

It is preferable that the first extension 601 and the second extension 603 of the knob 600 are formed such that the distance r1 from the axis center O to the external circumferential surface of the first extension 601 is larger than the distance r2 from the axis center O to the external circumferential surface of the second extension 603 when the first extension 601 and the second extension 603 are seen from above. The second extension 203 can be manufactured with a minimum radius due to this structure, so the string adjuster of the present invention can be manufactured in a compact size.

The string adjuster of the present invention can be variously applied to underwear or wearable products for women and can be made compact.

The knob 600 has an anti-reverse part 611 and a driving gear part 613 therein.

The anti-reverse part 611 of the knob 600 has gear teeth 615 formed in a shape protruding toward the base 200. That is, the gear teeth 615 constituting the anti-reverse part 611 of the knob 600 protrude toward the base 200 in parallel with the axis.

In the anti-reverse part 611 of the knob 600, inclined gear teeth 615 are circularly disposed on the surface of the knob 600 facing the base 200. The anti-reverse part 611 of the knob 600 can be engaged with the gear teeth 413 of the anti-reverse arm 409 of the second housing 400. The anti-reverse part 611 of the knob 600 is engaged with the gear teeth 413 of the anti-reverse arm 409 of the second housing 400, thereby preventing backward rotation of the knob 600 or the bobbin 700. That is, this state is the winding mode.

The driving gear part 613 of the knob 600 has gear teeth 617 protruding toward the base 200. That is, the gear teeth 617 constituting the driving gear part 613 of the knob 600 are formed in a shape protruding toward the base 200 in the direction parallel with the axis. The gear teeth 617 of the driving gear part 613 of the knob 600 are circularly disposed at the center portion inside the anti-reverse part 611. The driving gear part 613 of the knob 600 is coupled to the bobbin 700, thereby being able to rotate the bobbin 700.

The gear teeth 615 constituting the anti-reverse part 611 of the knob 600 are inclined in the opposite direction to the gear teeth 617 of the driving gear part 613 of the knob 600. Accordingly, the gear teeth 615 constituting the anti-reverse part 611 of the knob 600 serve to prevent backward rotation of the knob 600, and the driving gear part 613 of the knob 600 serves to rotate the bobbin 700 by being coupled to the bobbin 700

The gear teeth 615 constituting the anti-reverse part 611 of the knob 600 are larger than the gear teeth 617 of the driving gear part 613 of the knob 600. The size of the gear teeth 617 of the driving gear part 613 of the knob 600 can be minimized by this structure, so the entire height of the string adjuster can be reduced. Accordingly, the string adjuster of the first exemplary embodiment of the present invention can be manufactured in a compact size.

The gear teeth 617 of the driving gear part 613 of the knob 600 are inclined at a larger angle than the gear teeth 615 constituting the anti-reverse part 611 of the knob 600. When the knob 600 and the bobbin 700 are engaged with each other, a gap is reduced by this structure, so they can be easily engaged and disengaged and can be easily aligned. Further, the winding mode and the releasing mode are smoothly operated.

When the bobbin 700 is disposed in the first housing 300 and combined with the knob 600, the bobbin 700 is rotated with the knob 600, whereby a string is wound. An end of a string may be tied on the bobbin 700 or the middle portion of a string passing through the bobbin 700 may be hooked to the bobbin 700.

Figure 16:
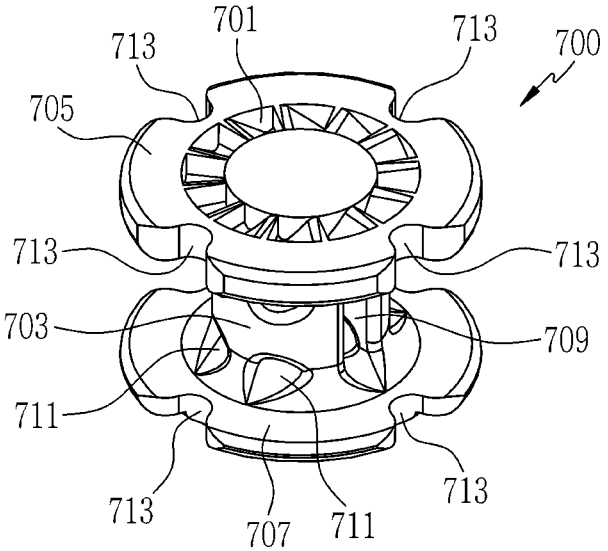
FIG. 16 is a perspective view showing a bobbin of the first exemplary embodiment of the present invention.

The bobbin 700 has a driven gear part 701 corresponding to the driving gear part 613 of the knob 600 to be engaged with the driving gear part 613 (see FIG. 16).

The driven gear part 701 of the bobbin 700 may have a shape having gear teeth protruding in the direction parallel with the axis. However, the driven gear part 701 of the bobbin 700 is hollowed out and recessed on the top of the bobbin 700 so that the driving gear part 613 of the knob 600 can be inserted therein. The height of the string adjuster is minimized by this structure, so the string adjuster can be manufactured in a compact size.

The driven gear part 701 of the bobbin 700 can be engaged with the driving gear part 613 of the knob 600. When the knob 600 is rotated with the driven gear part 701 of the bobbin 700 and the driving gear part 613 of the knob 600 engaged with each other, the bobbin 700 is also rotated. Accordingly, the bobbin 700 can wind a string. The structure in which the driven gear part 701 of the bobbin 700 and the driving gear part 613 of the knob 600 are engaged with each other in the direction parallel with the axis increases torque, whereby a string can be smoothly wound on the bobbin 700 even if tension is generated in the string.

The bobbin 700 may include a column part 703, a first plate 705, and a second plate 707. A string may pass through the column part 703 of the bobbin 700 or may be tied on the column part 703, and a string may be wound on the external circumferential surface of the column part 703.

The column part 703 of the bobbin 700 may have an oblong groove 709 formed perpendicular to the rotation axis at the center portion. The column part 703 of the bobbin 700 has a plurality of string fitting grooves 711 formed through the oblong groove 709. The string fitting grooves 711 of the column part 703 of the bobbin 700 may be formed to cross the oblong groove 709 perpendicularly or at a predetermined angle (see FIGS. 17 and 18). Since the oblong groove 709 and the string fitting groove 711 formed at the column part 703 of the bobbin 700, a string can be alternately fitted in the oblong groove 709 and the string fitting grooves 711, so the string can be easily fixed or tied.

The first plate 705 of the bobbin 700 may be integrally formed with the column part 703 on a surface facing the knob 600 which is the top of the column part 703. The second plate 707 of the bobbin 700 may be integrally formed with the column part 703 on a side opposite to the knob 600 that is the bottom of the column part 703.

The first plate 705 and the second plate 707 of the bobbin 700 have a guide groove 713 hollowed out toward the center of the axis and guiding a string. The guide groove 713 guides a string being fitted into the bobbin 700, whereby the string can be easily fitted to the column part 703 of the bobbin 700. The bobbin 700 with a string fitted therein may be inserted in the internal space of the second housing 400. That is, a string is fitted into the guide groove 713 of the bobbin 700 when the bobbin 700 is fitted into the second housing 400 after the string is fitted in the bobbin 700 with the bobbin 700 and the second housing 400 separated. Accordingly, the bobbin 700 can be easily inserted into the second housing 400.

The bobbin 700 has a rotation shaft protrusion 715 on the bottom thereof, that is, the surface facing the base 200. The rotation shaft protrusion 715 of the bobbin 700 is fitted in a rotary shaft groove 213 of the base 200, thereby serving to maintain the rotation axis. The rotation shaft protrusion 715 of the bobbin 700 functions as a rotary shaft when the bobbin 700 is rotated, whereby the bobbin 700 can be stably rotated. Although an example in which the rotation shaft protrusion 715 is formed at the bobbin 700 and the rotation shaft groove 213 is formed at the base 200 was described in the first exemplary embodiment of the present invention, the present invention is not limited thereto, and the groove and the protrusion may be switched.

Figure 17:
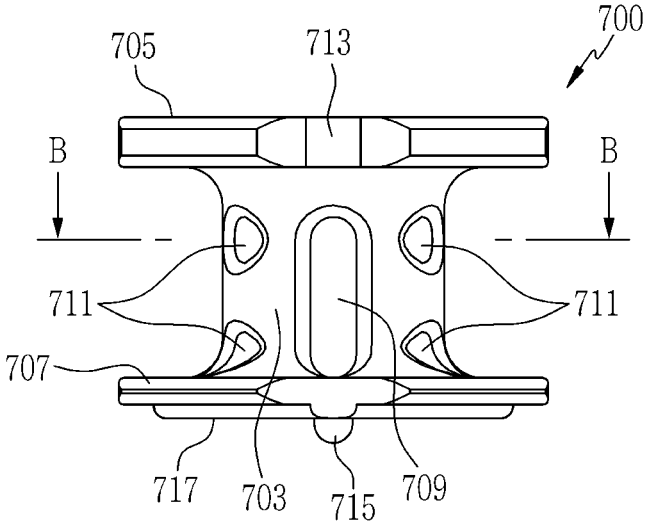
FIG. 17 is a front view of FIG. 16.
Figure 18:
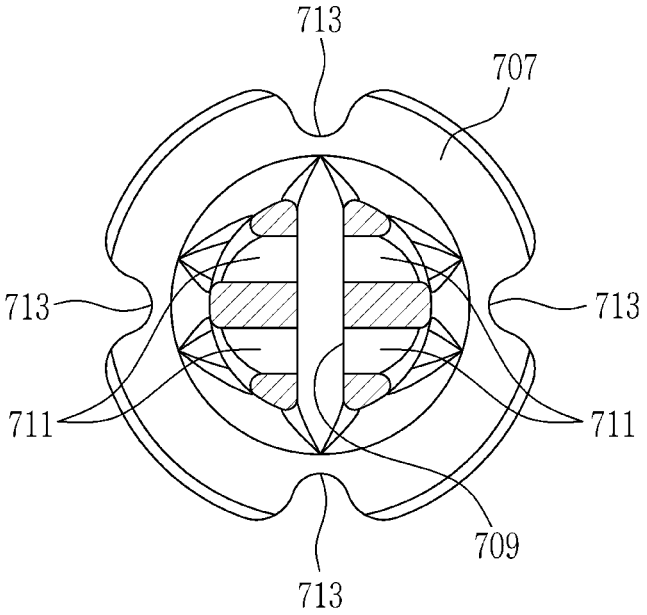
FIG. 18 is a cross-sectional view cutting and showing the part B-B in FIG. 17.

The bobbin 700 has a rotation guide protrusion 717 on the bottom thereof, that is, the surface facing the base 200. The rotation guide protrusion 717 of the bobbin 700, as shown in FIGS. 17 and 18, has a cylindrical shape having a predetermined height and protruding toward the base 200. The rotation guide protrusion 717 of the bobbin 700 is fitted in the rotation guide groove 211 of the base 200. Since the rotation guide protrusion 717 of the bobbin 700 has a predetermined thickness (height), the bobbin 700 maintains a stable posture in the rotation guide groove 211 of the base 200 even if the bobbin 700 moves in the direction parallel with the axis when rotating. Accordingly, the bobbin 700 maintains a stable posture even if it moves a predetermined section in the direction parallel with the axis while rotating. This structure of the first exemplary embodiment of the present invention can further improve stability of operation.

The operation process of the first exemplary embodiment of the present invention is described hereafter.

First, a worker couples the coupling extension 205 of the base 200 to a wearable product through sewing, bonding, or the like. The worker assembles and couples the first housing 300 and the second housing 400 to the base 200. The worker fits the arranging protrusions 403 of the second housing 400 into the arranging grooves 313 of the first housing 300. Accordingly, the first housing 300 and the second housing 400 can be arranged and fixed with the fitting protrusions 401 of the second housing 400 fitted in the second fitting grooves 311 of the first housing 300.

Further, the first housing 300 and the second housing 400 are combined with the coupling protrusions 315 of the first housing 300 fitted in the coupling grooves 407 of the second housing 400. Accordingly, the first housing 300 and the second housing 400 are maintained in a firmly fixed state.

The fitting protrusions 317 of the first housing 300 may be fitted in the fitting grooves 217 of the base 200. Further, the first fitting protrusion 305 of the first housing 300 can be fitted in the first fitting groove 209 of the base 200.

Accordingly, the first housing 300 and the second housing 400 are fixed to the base 200.

The worker inserts a string connected to the product into the first string inserting portion 207 of the base 200, the string inserting portion 309 of the first housing 300, and the string inserting portions 405 of the second housing 400. The worker fits the front end of the string into the string fitting groove 711 of the bobbin 700 and passes the front end through the oblong groove 709 of the bobbin 700. In this process, the worker may tie the end of the string to the string fitting groove 711 of the oblong groove 709 or may just pass the front end of the string through the string fitting groove 711 or the oblong groove 709 of the bobbin and then fix the end to the wearable product. The worker may use one string, but may use several string by fitting or tying and passing several strings into or through the string fitting groove 711 and the oblong groove 709 of the bobbin 700. The worker inserts the bobbin 700 into the second housing 400 and couples the knob 600 to the first housing 300 by pushing the knob 600 toward the base 200.

Figure 5:
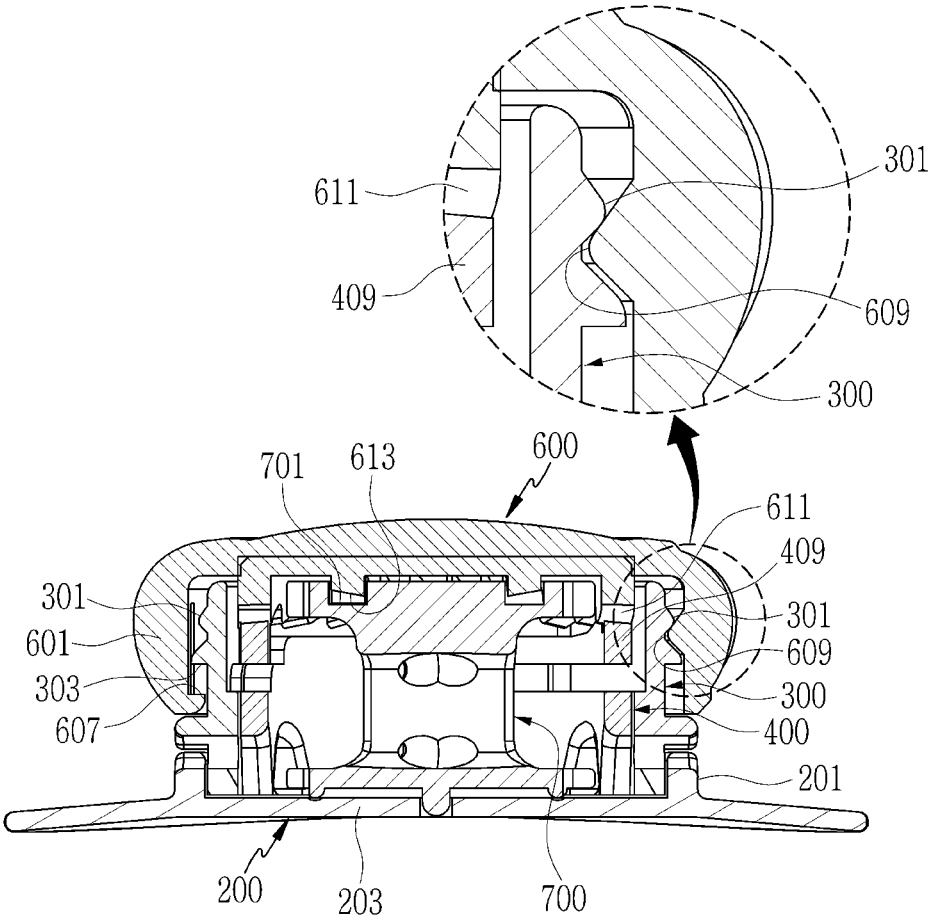
FIG. 5 is a cross-sectional view cutting and showing the part A-A in FIG. 1.
Figure 19:
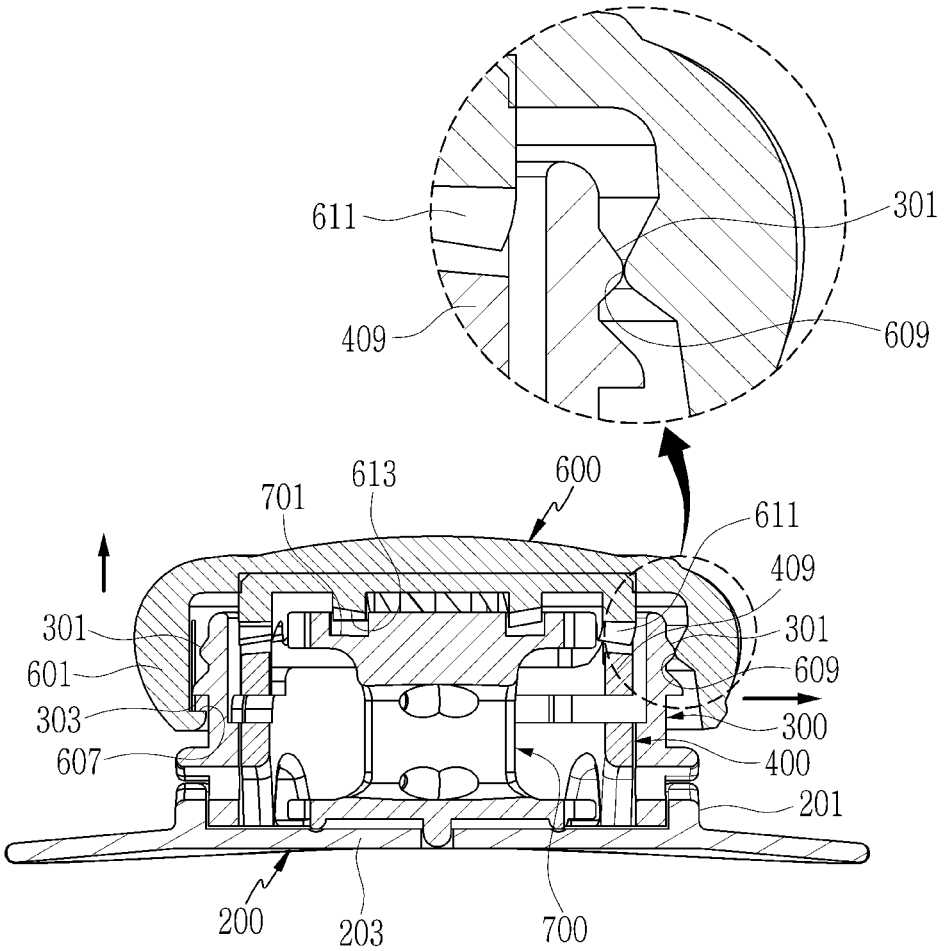
FIG. 19 is a view illustrating the operation process of the first exemplary embodiment of the present invention.
Figure 20:
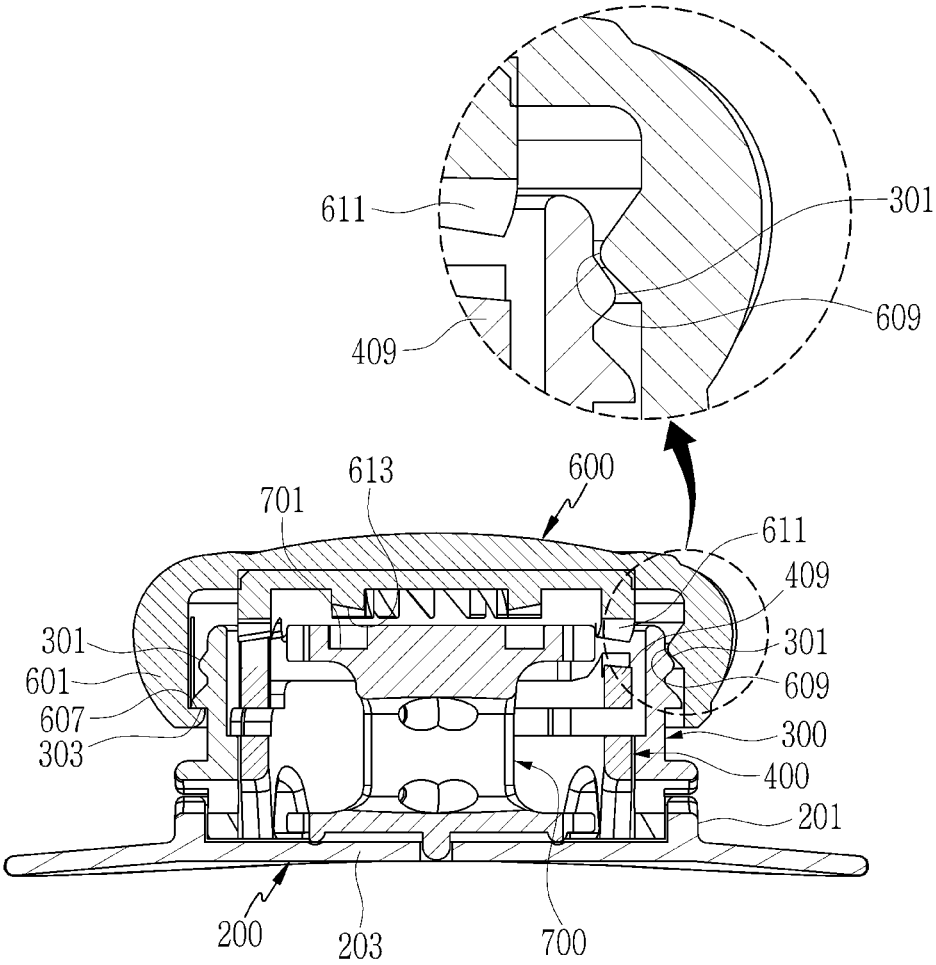
FIG. 20 is a view illustrating the unwound state of the first exemplary embodiment of the present invention.

Accordingly, the string adjuster of the first exemplary embodiment of the present invention can be assembled in the shape shown in FIG. 5. FIG. 5 is a view showing the winding mode state of the string adjuster, FIG. 19 is a view showing a process in which the string adjuster is moved for the releasing mode from the winding mode, and FIG. 20 is a view showing the state in which the string adjuster has been moved for the releasing mode.

First, the state in which a user winds a string on the bobbin 700 using the string adjuster is described. As shown in FIG. 5, the driving gear part 613 of the knob 600 is in mesh with the driven gear part 701 of the bobbin 700. In other words, the gear teeth 617 of the driving gear part 613 of the knob 600 are in mesh with the gear teeth of the driven gear part 701 of the bobbin 700. That is, the string adjuster is in the winding mode.

The anti-reverse part 611 of the knob 600 is coupled to the anti-reverse arm 409 of the second housing 400. In other words, the gear teeth 615 of the anti-reverse part 611 of the knob 600 are in mesh with the gear teeth 413 of the anti-reverse arm 409 of the second housing 400. The anti-reverse arm 409 of the second housing 400 is maintained in the state moved in the direction parallel with the axis by the space 411 of the second housing 400.

The knob 600 keeps the anti-reverse part 611 of the knob 600 and the anti-reverse arm 409 of the second housing 400 in mesh with each other, whereby backward rotation is prevented.

When the user needs to tighten the string in this state, the user rotates the knob 600 in one direction. Accordingly, the bobbin 700 is rotated together by rotation of the knob 600, whereby the string is wound on the column part 703 of the bobbin 700. Even if the user stops rotating the knob 600 after the string is wound on the column part 703, the anti-reverse part 611 of the knob 600 and the anti-reverse arm 409 of the second housing 400 keep in mesh with each other, whereby tension of the string is maintained. That is, rotation of the string in the unwinding direction is restricted.

When the bobbin 700 is rotated, as described above, the rotation shaft protrusion 715 of the bobbin 700 is fitted in the rotation shaft groove 213 of the base 200, so the bobbin 700 is stably rotated about the rotation shaft protrusion 715. When the bobbin 700 is rotated, the bobbin 700 is rotated with the rotation guide protrusion 717 inserted in the rotation guide groove 211 of the base 200. Accordingly, even if the bobbin 700 is spaced in the direction parallel with the axis, the bobbin 700 maintains the posture while rotating, so the bobbin 700 can tightens the string with a large force while stably rotating.

The releasing mode in which a user loosens a string or unties a string is described hereafter.

The user pulls the knob 600 away from the base 200. Accordingly, the winding determination protrusion 609 formed at the second extension 603 of the knob 600 slides over the reference stopping portion 301 of the first housing 300 (shown in FIG. 19). In this process, the second extension 603 of the knob 600 is radially deformed toward the center of the axis. That is, since the second extension 603 of the knob 600 has elasticity and has a free end due to the spacing groove 605, the second extension is radially deformed around the axis.

The user keeps pulling the knob 600 away from the base 200. Accordingly, the winding determination protrusion 609 formed at the second extension 603 of the knob 600 completely slides over the reference stopping portion 301 of the first housing 300 (shown in FIG. 20). In this process, the second extension 603 of the knob 600 is returned to the initial position toward the center of the axis by elasticity.

Accordingly, the driving gear part 613 of the knob 600 is separated from the driven gear part 701 of the bobbin 700. In this process, the anti-reverse part 611 of the knob 600 is also separated from the anti-reverse arm 409 of the second housing 400. That is, the bobbin 700 becomes to be able to freely rotate. Accordingly, the string adjuster enters the releasing mode. Accordingly, since the bobbin 700 can be freely rotated, the user can loose the string.

If the user further pulls the knob 600 away from the base 200, the counter-anti-separator 607 formed at the first extension 601 of the knob 600 comes in close contact with the anti-separator 303 of the first housing 300. Accordingly, it is possible to prevent the knob 600 from separating from the first housing 300 and to keep the knob 600 firmly coupled to the first housing 300.

Meanwhile, when the anti-reverse arm 409 of the second housing 400 is engaged with or separated from the anti-reverse part 611 of the knob 600, the side of the anti-reverse arm 409 comes in close contact with the inner wall of the first housing 300, whereby radial movement is prevented. Since the anti-reverse arm 409 of the second housing 400 is prevented from radially moving with only the free end thereof moving in the direction parallel with the axis, damage due to a large force can be reduced, so durability of the string adjuster is improved.

In particular, since the second extension 603 of the first exemplary embodiment of the present invention is an elastic part that is deformed radially around the axis, the second extension 603 can be smoothly operated even through a string is fully wound on the bobbin 700. Further, since the second extension 603 of the first exemplary embodiment of the present invention is an elastic part that is deformed radially around the axis, it is possible to increase the volume of strings that are wound on the bobbin 700 in a limited space. Accordingly, the string adjuster of the first exemplary embodiment of the present invention can maximally used the space of the exterior circumference of the bobbin 700 in which strings are wound, a thick string can be easily applied and more strings can be wound even if they have the same thickness. Therefore, usability of the string adjuster of the first exemplary embodiment of the present invention can be increased for variable products.

Further, even if an external force is applied to the string adjuster of the first exemplary embodiment of the present invention from the outside of the second extension 603, the second extension 603 is not deformed, so the winding mode can be firmly maintained. That is, the string adjuster of the first exemplary embodiment of the present invention stably maintains the winding state even if a force applied from the outside is generated, the quality of a product can be improved.

Figure 21:
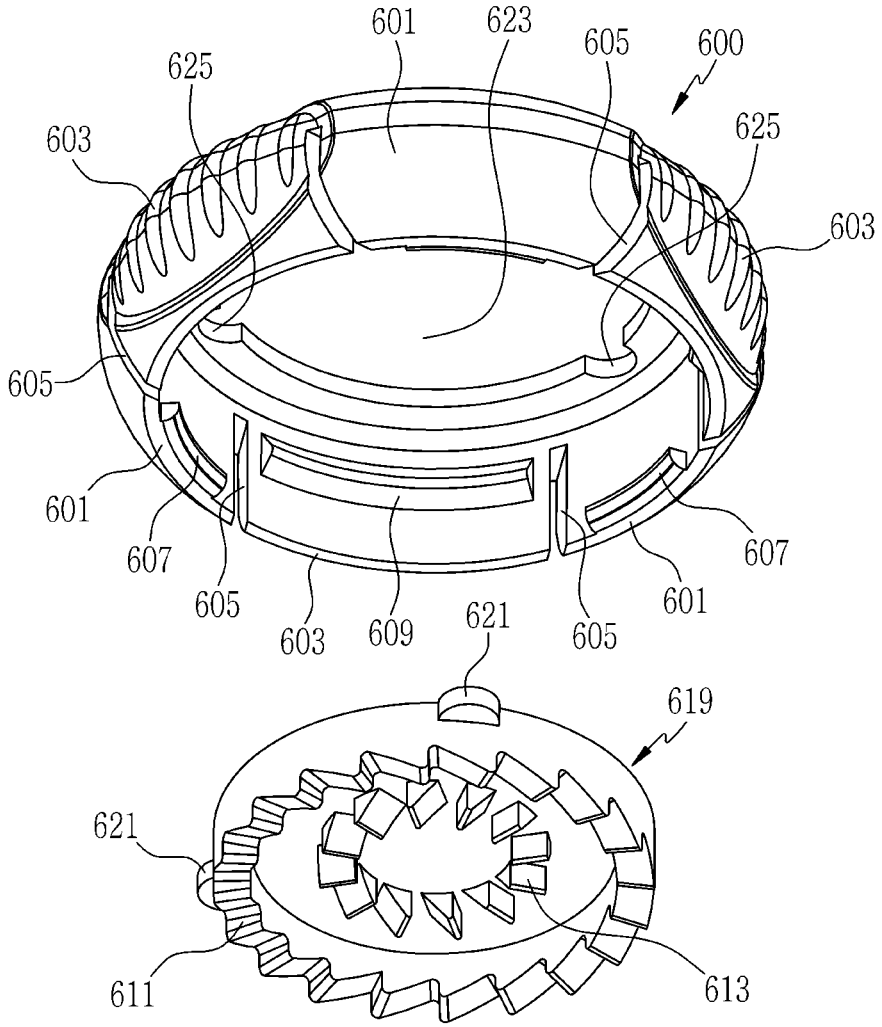
FIG. 21 is a view illustrating a second exemplary embodiment of the present invention.

FIG. 21 is a view illustrating a second exemplary embodiment of the present invention, in which a knob 600 is shown. In the description of the second exemplary embodiment of the present invention, components having the same functions are given the same reference numerals of the first exemplary embodiment for the convenience of description. The above description is referred to for the same configuration of the second exemplary embodiment of the present invention as that of the first exemplary embodiment, and only different configuration is described.

The knob 600 of the second exemplary embodiment of the present invention may include a gear plate 619 having an anti-reverse part 611 and a driving gear part 613. The gear plate 619 has the anti-reverse part 611 and the driving gear part 613 and may be manufactured as a separate part. The gear plate 619 separately manufactured as described above has a space inside the knob 600, so the gear plate 619 can be coupled to the knob 600 by fitting. The gear plate 619 has the anti-reverse part 611 and the driving gear part 613 on a surface, and a plurality of locking protrusions 621 circumferentially formed on the external circumferential surface thereof.

The locking protrusions 621 of the gear plate 619 are firmly fixed to the knob 600 in the winding mode state, so stable operation is performed even though the knob 600 is rotated. Further, the locking protrusions 621 of the gear plate 619 maintain the posture when the gear plate 619 is thermally bonded to the knob 600 by ultrasonic waves, thereby being able to prevent poor assembly.

The knob 600 has a space 623 in which the gear plate 619 is fitted, and locking grooves 625. The gear plate 619 may be inserted and fixed in the space 623 of the knob 600 by fitting, bonding, or ultrasonic coupling. According to the second exemplary embodiment of the present invention, since the gear plate 619 is separately manufacture and coupled to the knob 600, it is advantageous in forming the precision of a product can be improved.

Figure 22:
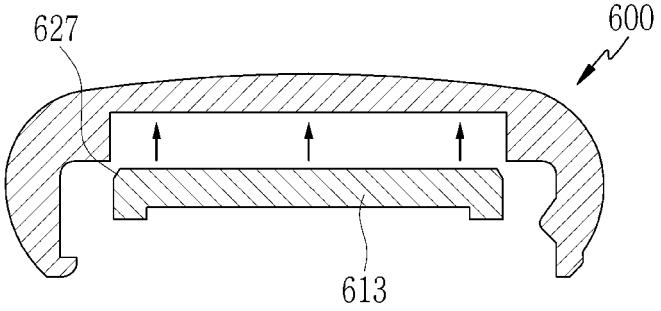
FIG. 22 is a view illustrating a third exemplary embodiment of the present invention.

FIG. 22 is a view illustrating a third exemplary embodiment of the present invention, in which a knob 600 is shown. The third exemplary embodiment of the present invention is a different example from the second exemplary embodiment, in which the above description is referred to for the same parts and only different configuration is described.

A gear plate 619 of the third exemplary embodiment of the present invention has an insertion guide 627 formed by chamfering the edge thereof. The gear plate 619 is easily inserted into the space 623 of the knob 600 by the insertion guide 627. Accordingly, the third exemplary embodiment of the present invention can improve convenience of assembly of the knob 600.

Figure 23:
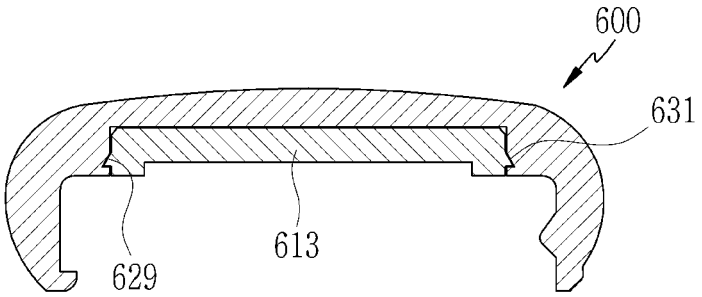
FIG. 23 is a view illustrating a fourth exemplary embodiment of the present invention.

FIG. 23 is a view illustrating a fourth exemplary embodiment of the present invention, in which a knob 600 is shown. The fourth exemplary embodiment of the present invention is a different example from the second exemplary embodiment, in which the above description is referred to for the same parts and only different configuration is described.

According to the fourth exemplary embodiment of the present invention, a fitting groove 629 radially formed on the interior circumferential surface of the space 623, and a fitting protrusion 631 corresponding to the fitting groove 629 is formed on the external circumferential surface of the gear plate 619. Accordingly, the knob 600 of the fourth exemplary embodiment of the present invention can be assembled with the fitting protrusion 631 of the gear plate 619 fitted in the fitting groove 629 of the knob 600. That is, the gear plate 619 can be coupled to the knob 600 of the fourth exemplary embodiment of the present invention by only fitting, convenience of assembly can be improved. The fourth exemplary embodiment of the present invention shows that the present invention can be achieved in various ways.

Figure 24:
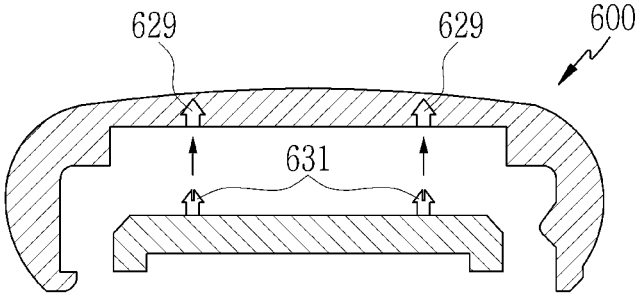
FIG. 24 is a view illustrating a fifth exemplary embodiment of the present invention.

FIG. 24 is a view illustrating a fifth exemplary embodiment of the present invention, in which a knob 600 is shown. The fifth exemplary embodiment of the present invention is a different example from the fourth exemplary embodiment, in which the above description is referred to for the same parts and only different configuration is described.

According to the fifth exemplary embodiment of the present invention, another fitting groove 629 is formed on a surface of the space 623 of the knob 600, that is, the surface facing the base 200, and a fitting protrusion 631 is formed on a surface facing the knob 600 of the gear plate 619 to correspond to the fitting groove 629. Accordingly, the knob 600 of the fifth exemplary embodiment of the present invention can be assembled with the fitting protrusion 631 of the gear plate 619 fitted in the fitting groove 629 of the knob 600. That is, the gear plate 619 can be coupled to the knob 600 of the fifth exemplary embodiment of the present invention by only fitting, convenience of assembly can be improved. The fifth exemplary embodiment of the present invention shows that the present invention can be achieved in various ways.

Figure 25:
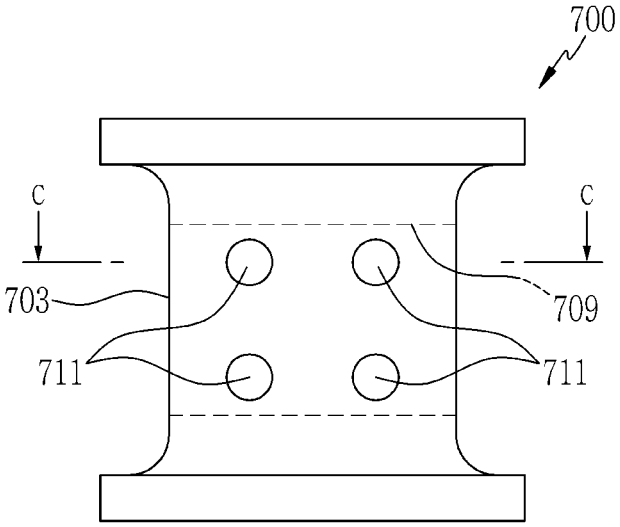
FIG. 25 is a view illustrating a sixth exemplary embodiment of the present invention.
Figure 26:
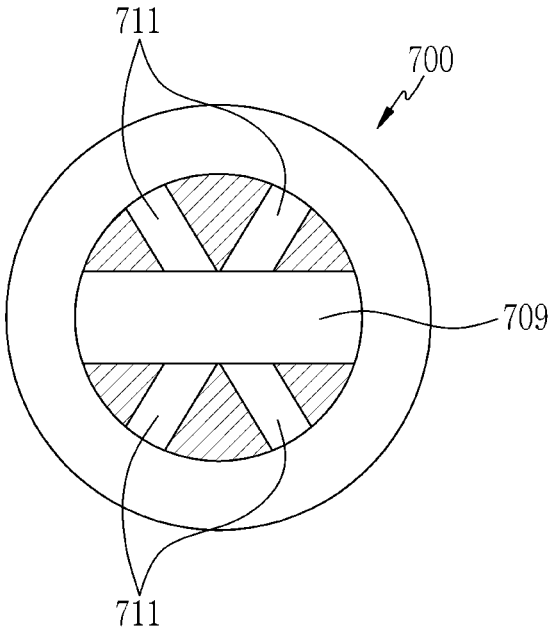
FIG. 26 is a cross-sectional view cutting and showing the part C-C in FIG. 25.

FIG. 25 is a view illustrating a sixth exemplary embodiment of the present invention and FIG. 26 is a cross-sectional view cutting and showing the part C-C in FIG. 25, in which a bobbin 700 is shown. The sixth exemplary embodiment of the present invention is another example of the bobbin 700 described in the first exemplary embodiment, so the above description is referred to for the same components as those of the first exemplary embodiment and only different configuration is described.

The bobbin 700 in the first exemplary embodiment of the present invention has the string fitting grooves 711 perpendicularly passing through the oblong groove 709, but, in the bobbin 700 of the sixth exemplary embodiment of the present invention, fitting grooves 711 are formed at a predetermined angle through the oblong groove 709. That is, the fitting grooves 711 are formed across each other in the oblong groove 709 in the sixth exemplary embodiment of the present invention. According to the bobbin 700 of the sixth exemplary embodiment of the present invention, it is possible to pass strings across each other through the oblong groove 709 and the fitting grooves 711. According to the sixth exemplary embodiment of the present invention, it is possible to easily fit strings. In particular, the bobbin 700 of the sixth exemplary embodiment of the present invention can more easily fix strings when the strings, for example, are wires having relatively large elasticity. The sixth exemplary embodiment of the present invention has a structure suitable for using various kinds of strings. The sixth exemplary embodiment of the present invention can be variously applied to wearable products, so it has the advantage that the usability is maximized.

Figure 27:
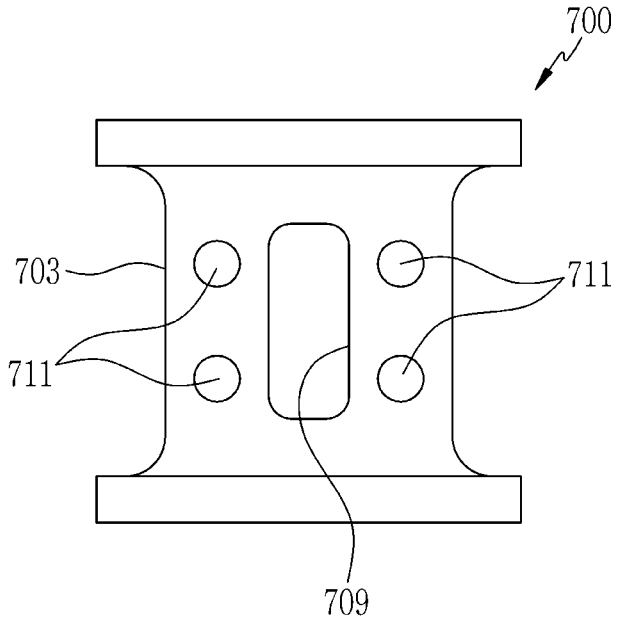
FIG. 27 is a view illustrating a seventh exemplary embodiment of the present invention.

FIG. 27 is a view illustrating a seventh exemplary embodiment of the present invention, in which a knob 700 is shown. The seventh exemplary embodiment of the present invention is another example of the bobbin 700 described in the first exemplary embodiment, so the above description is referred to for the same components as those of the first exemplary embodiment and only different configuration is described.

According to the seventh exemplary embodiment of the present invention, string fitting grooves 711 are formed in parallel with the oblong groove 709 without passing through the oblong groove 709. According to the seventh exemplary embodiment of the present invention, strings can be fitted or fixed in the oblong groove 709 and the string fitting grooves 711 in various ways, depending on the kinds of products and the kinds of the strings. The bobbin 700 of the seventh exemplary embodiment of the present invention shows that the present invention can be achieved in various ways.

Figure 28:
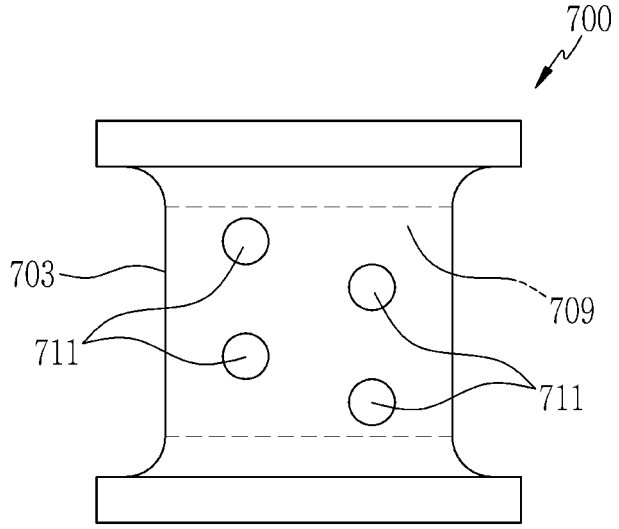
FIG. 28 is a view illustrating an eighth exemplary embodiment of the present invention.

FIG. 28 is a view illustrating an eighth exemplary embodiment of the present invention, in which a knob 700 is shown. The eighth exemplary embodiment of the present invention is another example of the bobbin 700 described in the sixth exemplary embodiment, so the above description is referred to for the same components as those of the sixth exemplary embodiment and only different configuration is described.

In the bobbin 700 according to the eighth exemplary embodiment of the present invention, string fitting grooves 711 are disposed at different positions in the direction facing the base 200 or the knob 600. That is, although the openings of the string fitting grooves 711 are positioned in parallel in the bobbin 700 of the sixth exemplary embodiment, the inlets and the outlets of the string fitting grooves 711 may be alternately disposed in the bobbin 700 of the eighth exemplary embodiment of the present invention. The eighth exemplary embodiment of the present invention may also be variously applied, depending on the kinds of wearable products and the kinds of strings. The bobbin 700 of the eighth exemplary embodiment of the present invention shows that the present invention can be achieved in various ways.

Figure 29:
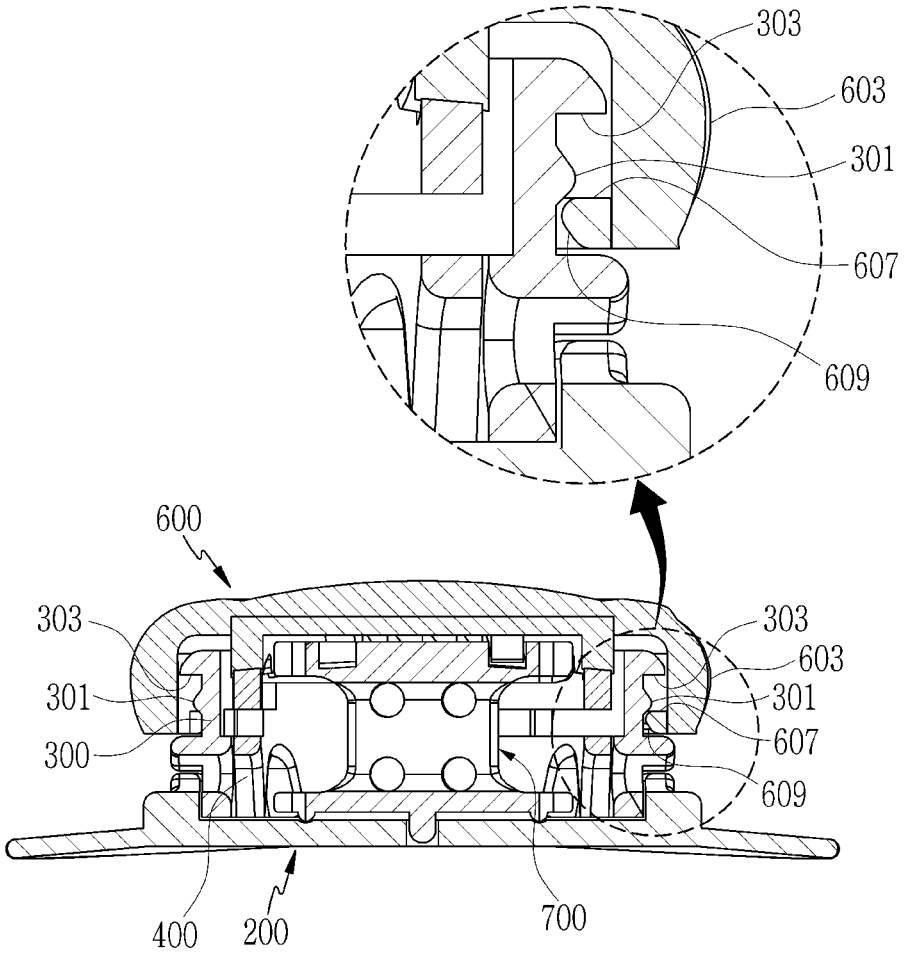
FIG. 29 is a cross-sectional view of a string adjuster taken in the axial direction to describe a ninth exemplary embodiment of the present invention.
Figure 30:
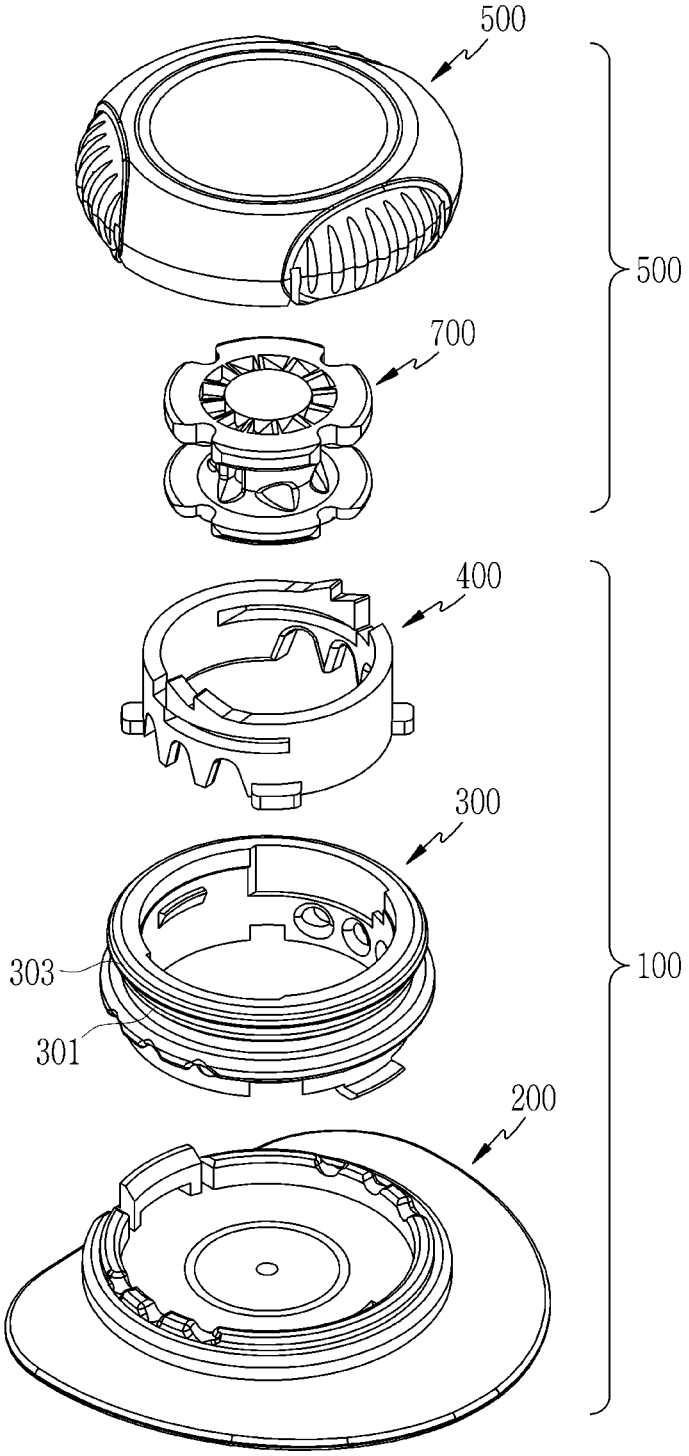
FIG. 30 is an exploded perspective view of FIG. 29.
Figure 31:
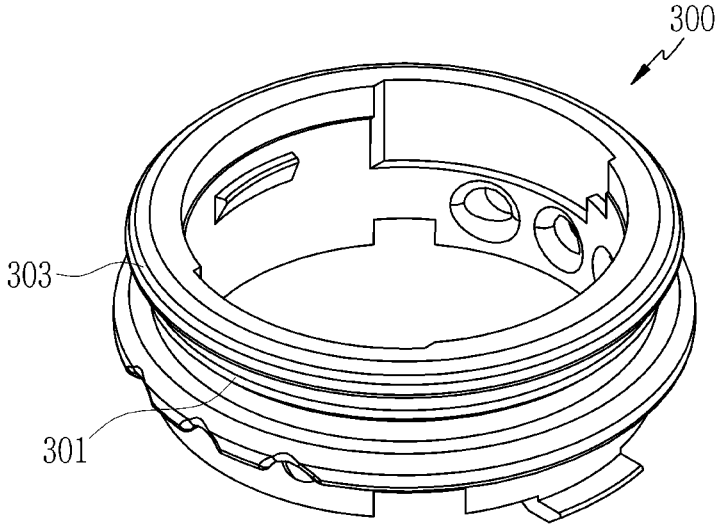
FIG. 31 is a perspective view showing a first housing to describe the ninth exemplary embodiment of the present invention.
Figure 32:
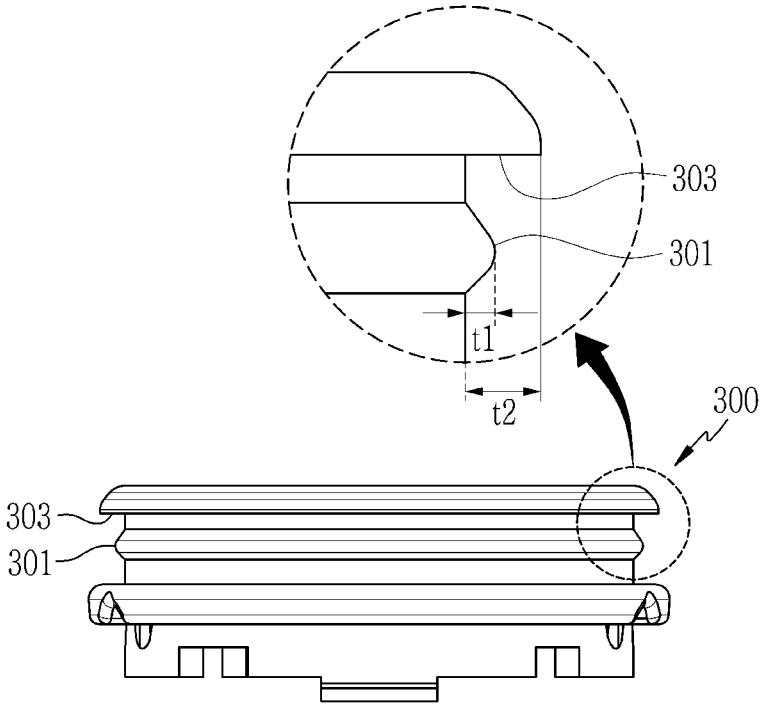
FIG. 32 is a perspective view showing a side of the first housing to illustrate the ninth exemplary embodiment of the present invention.
Figure 33:
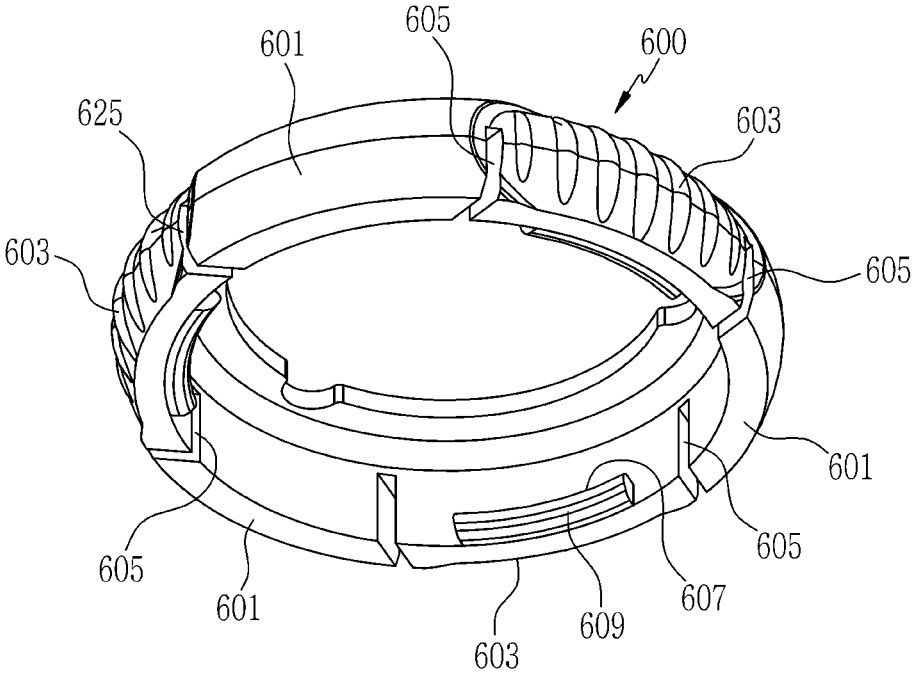
FIG. 33 is a perspective view showing a knob seen from the bottom to describe the ninth exemplary embodiment of the present invention.

FIG. 29 is a cross-sectional view of a string adjuster taken in the vertical direction to describe a ninth exemplary embodiment of the present invention and FIG. 30 is an exploded perspective view of FIG. 29, which shows a string adjuster. FIG. 31 is a perspective view showing a first housing 300 of the ninth exemplary embodiment of the present invention and FIG. 32 is a side view of FIG. 31. FIG. 33 is a bottom perspective view showing a knob 600 to describe the ninth exemplary embodiment of the present invention. In the ninth exemplary embodiment of the present invention, the above description is referred to for the same components as those of the first exemplary embodiment and only different configuration is described.

As compared with the first exemplary embodiment, the ninth exemplary embodiment of the present invention is different in the positions of the anti-separator 303 and the reference locking portion 301 formed at the first housing 300.

Further, as compared with the first exemplary embodiment, the ninth exemplary embodiment of the present invention is different in that the counter-anti-separator 607 and the winding determination protrusion 609 of the knob 600 are integrally formed with the second extension as one protrusion.

According to the ninth exemplary embodiment of the present invention, the reference locking portion 301 is formed at the middle portion of the first housing 300 and the anti-separator 303 are disposed at the front end of the top of the first housing 300. According to the ninth exemplary embodiment of the present invention, the counter-anti-separator 607 and the winding determination protrusion 609 of the knob 600 are formed as one structure at the second extension 603 of the knob 600. That is, the counter-anti-separator 607 protrudes from the inner wall of the second extension 603 of the knob 600 and makes a flat surface on the opposite side to the base 200, whereby it can be locked to the anti-separator 303 of the first housing 300. The winding determination protrusion 609 is formed in a curved surface shape in the direction parallel with the axis at the axial end of the counter-anti-separator 607. It is preferable that the height of the anti-separator 303 protruding from the outer side wall of the first housing 300 is larger than the protrusive height of the reference locking portion 301 (see FIG. 32). Accordingly, the counter-anti-separator 607 can meet the anti-separator 303, and the winding determination protrusion 609 can slide over the reference locking portion 301.

The ninth exemplary embodiment of the present invention is similar in operation structure to the first exemplary embodiment, but the string adjuster can be manufactured in a compact size by further reducing the height.

As compared with the first exemplary embodiment, the knob 600 can be manufactured in a simpler structure in the ninth exemplary embodiment of the present invention.

Figure 34:
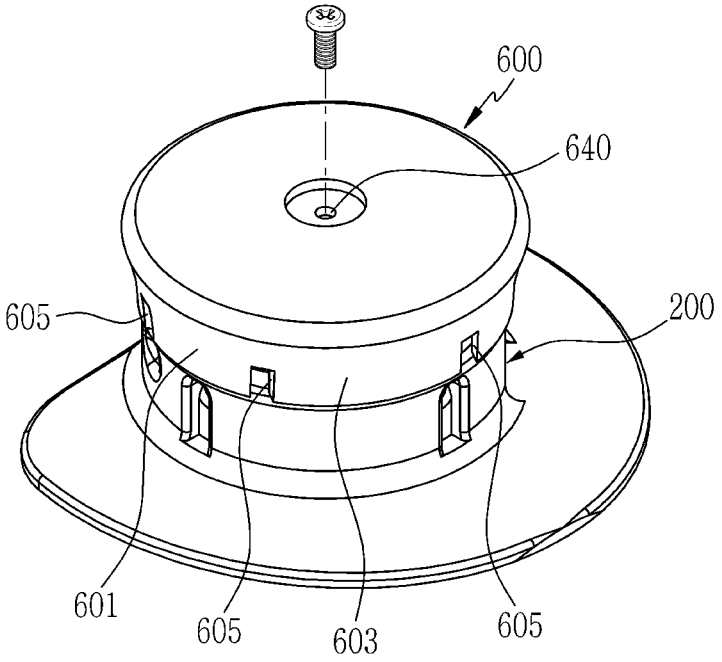
FIG. 34 is a top plan view showing a string adjuster to describe a tenth exemplary embodiment of the present invention.
Figure 35:
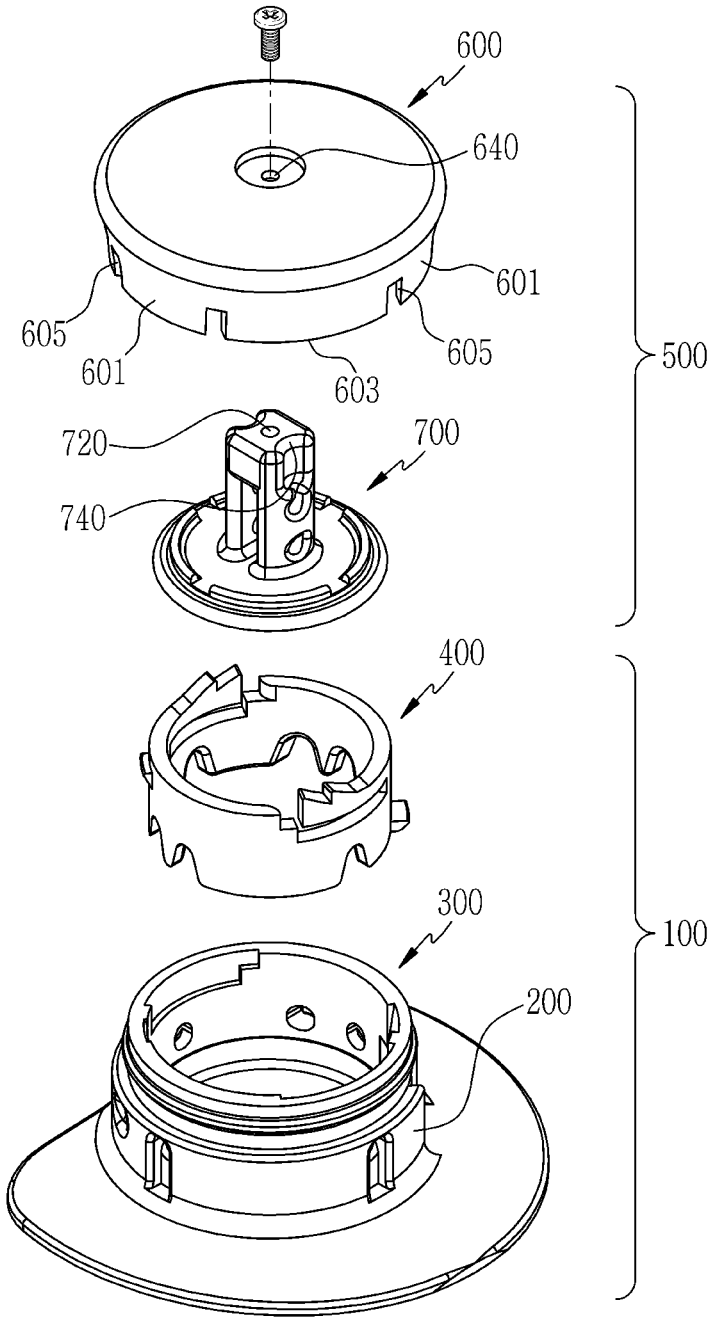
FIG. 35 is an exploded perspective view showing the string adjuster to describe the tenth exemplary embodiment of the present invention.
Figure 36:
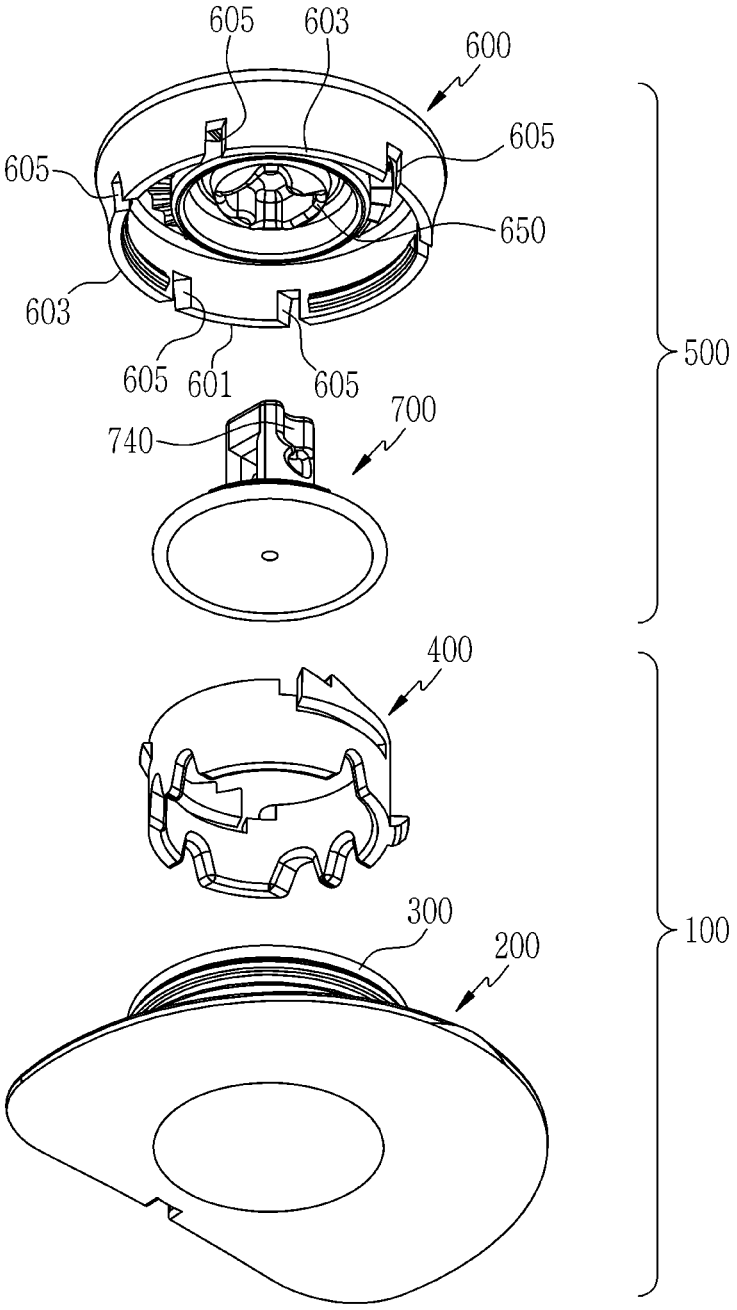
FIG. 36 is an exploded perspective view showing the string adjuster seen from the bottom to describe the tenth exemplary embodiment of the present invention.
Figure 37:
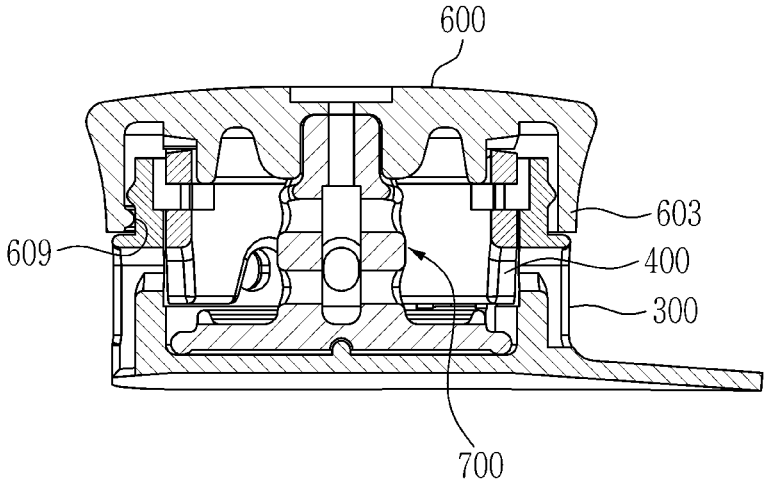
FIG. 37 is a cross-sectional view taken in the longitudinal direction FIG. 28.

FIG. 34 is a top plan view showing a string adjuster to describe a tenth exemplary embodiment of the present invention, FIG. 35 is an exploded perspective view of FIG. 34, FIG. 36 is an bottom exploded perspective view of FIG. 35, and FIG. 37 is a cross-sectional view taken in the vertical direction FIG. 34. In the tenth exemplary embodiment of the present invention, the above description is referred to for the same components as those of the first exemplary embodiment and only different configuration is described.

As compared with the first exemplary embodiment, the knob 600 and the bobbin 700 are integrally coupled to each other by a fastening member such as a bolt in the tenth exemplary embodiment of the present invention. That is, according to the tenth exemplary embodiment of the present invention, the driving gear part 13 of the knob 600, the driven gear part 710 of the bobbin 700, and the first plate 705 of the first exemplary embodiment are omitted.

In other words, the knob 600 has a bobbin fastening portion 640 formed through the center thereof and the bobbin 700 has a knob fastening portion 720 corresponding to the bobbin fastening portion 640 (see FIG. 35). Accordingly, the bobbin fastening portion 640 and the knob fastening portion 720 can be fixed by a fastening member.

As another example of the tenth exemplary embodiment of the present invention, the knob 600 and the bobbin 700 may be integrated by thermal bonding.

According to the tenth exemplary embodiment of the present invention, the center portion of the knob 600 and the center portion of the top of the bobbin 700 are fixed by a fastening member such as a bolt, whereby the knob 600 and the bobbin 700 are integrated. According to the tenth exemplary embodiment of the present invention, the driving gear part 613 of the knob 600, the driven gear part 701 of the bobbin 700, and the first plate 705 are omitted, so the string adjuster can be manufactured in a simpler structure. The tenth exemplary embodiment of the present invention is advantageous in injection molding, and the driving gear part 613 of the knob 600 and the driven gear part 701 of the bobbin 700 are omitted, the height of the entire adjuster can be further reduced.

The knob 600 has a bobbin fitting protrusion 650 at the center portion of the inside and the bobbin 700 has a knob fitting groove 740 corresponding to the bobbin fitting protrusion 650 (see FIG. 36). The bobbing fitting protrusion 650 and the knob fitting groove 740 firmly support each other when they are rotated, whereby stable operation is possible.

Figure 38:
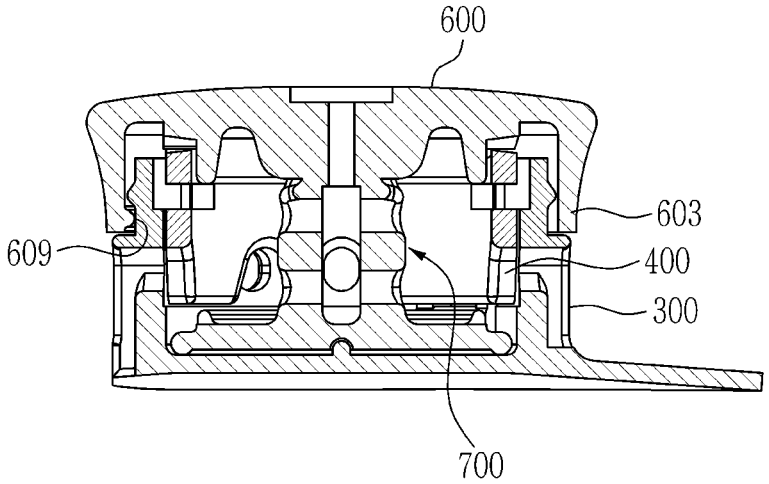
FIG. 38 is a cross-sectional view of a string adjuster taken in the vertical direction to describe an eleventh exemplary embodiment of the present invention.

FIG. 38 is a cross-sectional view of a string adjuster taken in the vertical direction to describe an eleventh exemplary embodiment of the present invention. In the eleventh exemplary embodiment of the present invention, the above description is referred to for the same components as those of the tenth exemplary embodiment and only different configuration is described.

According to the eleventh exemplary embodiment of the present invention, as compared with the tenth exemplary embodiment, there is a different in that the knob 600 and the bobbin 700 are manufactured in a separable type in the tenth embodiment, but the knob 600 and the bobbin 700 are integrally formed in the eleventh exemplary embodiment. The eleventh exemplary embodiment of the present invention can reduce the number of parts and improve convenience of assembly.

Although preferred exemplary embodiments of the present invention were described above, the present invention is not limited thereto and may be modified in various ways within the range of the claims, the detailed description, and the accompanying drawings, and these are also included in the range of the present invention.

The invention claimed is:

1. A string adjuster comprising:
a fixed unit including
a base, and
a housing connected to the base and having a space therein;
a rotation unit including a knob connected to the housing and rotating or moving a predetermined section in a direction parallel with an axis, and
a bobbin disposed in the fixed unit and rotating with rotation of the knob to wind a string,
wherein the housing includes
a reference locking portion, and
an anti-separator spaced apart from the reference locking portion and preventing separation of the knob, and
the knob includes
a first extension having a counter-anti-separator corresponding to the anti-separator and preventing separation from the housing,
a second extension having a winding determination protrusion determining winding and releasing modes, and
a spacing groove formed between the first extension and the second extension.

2. The string adjuster of claim 1, wherein:
the second extension
is an elastic part that radially moves and then returns when the winding determination protrusion slides over the reference locking portion.

3. The string adjuster of claim 1, wherein:
the first extension and the second extension
are alternately disposed along the external circumferential surface of the knob.

4. The string adjuster of claim 1, wherein:
in the first extension and the second extension,
when the knob is seen from above,
the distance from the center of the rotation axis of the knob to the external circumferential surface of the first extension
is larger than the distance from the center of the rotation axis of the knob to the external circumferential surface of the second extension.

5. The string adjuster of claim 1, wherein:
the knob includes
an anti-reverse part having gear teeth protruding toward the base therein, and
a driving gear part having gear teeth protruding toward the base therein, and formed at the center with respect to the anti-reverse part,
the housing
includes a first housing and a second housing disposed in the first housing,
the second housing
has an anti-reverser arm coupled to the anti-reverse part and preventing backward rotation of the knob, and
the bobbin
has a driven gear part coupled to the driving gear part and rotating the bobbin.

6. The string adjuster of claim 5, wherein:
the anti-reverse part and the anti-reverse arm
have gear teeth formed in the direction parallel with the axis, and
the driving gear part and the driven gear part
have gear teeth formed in the direction parallel with the axis.

7. The string adjuster of claim 5, wherein:
the anti-reverse arm
is integrally formed with the second housing, extends, has a free end, and has gear teeth protruding toward the knob, and a space is formed under the anti-reverse part such that the free end moves in the direction parallel with the axis when the protruding gear teeth of the anti-reverse part slide over the protruding gear teeth of the anti-reverse arm.

8. The string adjuster of claim 5, wherein:
the protruding gear teeth of the anti-reverse part
are inclined in the opposite direction to the protruding gear teeth of the driving gear teeth, and have an inclination angle that is different from the inclination angle of the gear teeth of the driving gear part.

9. The string adjuster of claim 5, wherein:
the gear teeth of the anti-reverse part
have a size that is larger than the size of the gear teeth of the driving gear part.

10. The string adjuster of claim 5, wherein:
the gear teeth of the driving gear part
have an inclination angle that is larger than the inclination angle of the gear teeth of the anti-reverse part.

11. The string adjuster of claim 7, wherein:
the anti-reverse part
is disposed in contact with or adjacent to the inner wall of the first housing so that radial movement of the external circumferential surface thereof is restricted by the inner wall of the first housing.

12. The string adjuster of claim 1, wherein:
the housing includes
a first housing coupled to or integrally formed with the base, and
a second housing disposed in the first housing.

13. The string adjuster of claim 12, wherein:
the first housing
has a coupling protrusion protruding toward the center from the interior circumferential surface, and
the second housing has a coupling groove correspondingly fitted on the coupling protrusion.

14. The string adjuster of claim 13, wherein:
the first housing
has one or more string inserting portions having hole shapes formed through the bottom, and
the second housing
has other string inserting portions corresponding to the string inserting portions.

15. The string adjuster of claim 1, wherein:
the bobbin
has a column part,
the column part
has an oblong groove formed through the center portion in a direction perpendicular to the axis, and
has one or more string fitting grooves formed in parallel with or through the oblong groove.

16. The string adjuster of claim 15, wherein:
the string fitting grooves are formed at a predetermined angle with respect to each other such as strings perpendicularly passing through the oblong groove or fitted in the oblong groove are disposed across each other.

17. The string adjuster of claim 1, wherein:

the bobbin includes a column part through which a string passes or to which is tied and on which a string is wound, a first plate integrally formed with the column part on the top of the column part, and a second plate integrally formed with the column part on the bottom of the column part, and the first plate and the second plate have a guide groove hollowed out toward the center of the axis and guiding strings.

18. The string adjuster of claim 1, wherein:

the bobbin has a rotation shaft protrusion on a surface facing the base, and the base has a rotation shaft groove corresponding to the rotation shaft protrusion.

19. The string adjuster of claim 1, wherein:

the bobbin has a rotation guide protrusion on a surface facing the base, and the base has a rotation guide groove guiding rotation of the bobbin with the rotation guide protrusion fitted therein.

20. The string adjuster of claim 1, wherein:

the knob includes a gear plate coupled to the inner surface thereof by fitting, bonding, or thermal bonding, and the gear plate includes an anti-reverse part having gear teeth protruding toward the base, and a driving gear part having gear teeth formed toward the base, and formed at the rotation center axis with respect to the anti-reverse part.

* * * * *